US011840095B2

(12) United States Patent
Alaganchetty

(10) Patent No.: US 11,840,095 B2
(45) Date of Patent: Dec. 12, 2023

(54) THERMOELECTRIC COOLING ASSEMBLY

(71) Applicant: Hand Held Products, Inc., Charlotte, NC (US)

(72) Inventor: Ramanathan Alaganchetty, Singapore (SG)

(73) Assignee: HAND HELD PRODUCTS, INC., Charlotte, NC (US)

( * ) Notice: Subject to any disclaimer, the term of this patent is extended or adjusted under 35 U.S.C. 154(b) by 422 days.

(21) Appl. No.: 17/223,761

(22) Filed: Apr. 6, 2021

(65) Prior Publication Data

US 2022/0315266 A1 Oct. 6, 2022

(51) Int. Cl.
*B41J 2/335* (2006.01)

(52) U.S. Cl.
CPC ..... *B41J 2/3358* (2013.01)

(58) Field of Classification Search
CPC ..... B41J 2/3358
See application file for complete search history.

(56) References Cited

U.S. PATENT DOCUMENTS

| | | | | |
|---|---|---|---|---|
| 8,725,026 | B2 | 5/2014 | Ikeda et al. | |
| 2011/0148973 | A1* | 6/2011 | Chappell | B41J 11/0015 347/18 |
| 2013/0127962 | A1* | 5/2013 | Yoda | B41J 11/0021 347/102 |

FOREIGN PATENT DOCUMENTS

| | | | | |
|---|---|---|---|---|
| CN | 111095694 A | * | 5/2020 | G02F 1/39 |
| JP | 2004130705 A | * | 4/2004 | |
| JP | 6225811 B2 | | 11/2017 | |

* cited by examiner

*Primary Examiner* — Justin Seo
(74) *Attorney, Agent, or Firm* — Alston & Bird LLP

(57) ABSTRACT

The present disclosure provides a printer apparatus including a thermoelectric cooling assembly and a processor coupled to the thermoelectric cooling assembly. The thermoelectric cooling assembly includes a thermoelectric cooling element that includes a first substrate, a second substrate, and a first plurality of semiconductor elements electrically coupled to a second plurality of semiconductor elements in a space between the first substrate and the second substrate. The thermoelectric cooling element includes a base plate electrically coupled to the first substrate. The base plate is positioned proximate to a plurality of labels traversing above the thermoelectric cooling assembly. The processor receives sensor signals indicative of a temperature of a label that comes in contact with the thermoelectric cooling assembly, compares the temperature of the label with a threshold temperature, and generates an output signal indicative of current supplied to the thermoelectric cooling element to adjust the temperature of the thermoelectric cooling element.

17 Claims, 7 Drawing Sheets

THERMOELECTRIC COOLING ASSEMBLY

TECHNICAL FIELD

Example embodiments of the present disclosure relate generally to a printer apparatus, more particularly, to a printer apparatus comprising a thermoelectric cooling assembly.

BACKGROUND

In a conventional printer that is used to print media content on a label, the adhesive in the label under the impact of heat or pressure application during the printing process may start oozing. The adhesive leakage may cause contamination in various parts of the printer such as, a platen roller, an optical verification unit, etc. The contamination caused by the adhesive leakage may also lead to media jam in the printer.

BRIEF SUMMARY

Various embodiments described herein illustrate a printer apparatus comprising a thermoelectric cooling assembly and a processor communicatively coupled to the thermoelectric cooling assembly. The thermoelectric cooling assembly is positioned downstream of a printhead in a print direction of the printer apparatus. The thermoelectric cooling assembly comprises a thermoelectric cooling element and a base plate. The thermoelectric cooling element comprises a first substrate, a second substrate separated from the first substrate by a space therebetween, and a first plurality of semiconductor elements electrically coupled to a second plurality of semiconductor elements in the space between the first substrate and the second substrate. The base plate is electrically coupled to the first substrate of the thermoelectric cooling element. The processor receives, from a sensor unit of the printer apparatus that is positioned proximate to the thermoelectric cooling assembly, sensor signals indicative of a temperature of a label of a plurality of labels of a media that comes in contact with the thermoelectric cooling assembly. The processor compares the temperature of the label of the plurality of labels with a threshold temperature. The processor generates an output signal indicative of current supplied to the thermoelectric cooling element of the thermoelectric cooling assembly to adjust the temperature of the thermoelectric cooling element, in response to the comparison.

Various embodiments described herein illustrate a printer apparatus comprising media hub, a printhead, a sensor unit, a thermoelectric cooling assembly, and a processor communicatively coupled to the sensor unit and the thermoelectric cooling assembly. The media hub supplies a media comprising a plurality of labels along a media path in a print direction of the printer apparatus. The printhead is positioned adjacent to the media path and downstream of the media hub in the print direction and prints content on the plurality of labels. The sensor unit is positioned downstream of the printhead in the print direction. The sensor unit generates sensor signals indicative of a temperature of a label of the plurality of labels comprising the printed content. The thermoelectric cooling assembly is positioned downstream of the printhead in the print direction and proximate to the sensor unit. The processor receives, from the sensor unit, sensor signals indicative of a temperature of a label of a plurality of labels of a media that comes in contact with the thermoelectric cooling assembly. The processor compares the temperature of the label of the plurality of labels with a threshold temperature. The processor generates an output signal indicative of current supplied to the thermoelectric cooling element of the thermoelectric cooling assembly to adjust the temperature of the thermoelectric cooling element, in response to the comparison.

Various embodiments described herein illustrate a method comprising receiving, from a sensor unit of the printer apparatus, sensor signals indicative of a temperature of a label of a plurality of labels of a media that comes in contact with a thermoelectric cooling assembly of the printer apparatus. The method further comprises comparing the temperature of the label of the plurality of labels with a threshold temperature. The method further comprises generating an output signal indicative of current supplied to the thermoelectric cooling assembly to adjust the temperature of the thermoelectric cooling assembly.

The above summary is provided merely for purposes of providing an overview of one or more exemplary embodiments described herein to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF THE INVENTION

Figure 1:
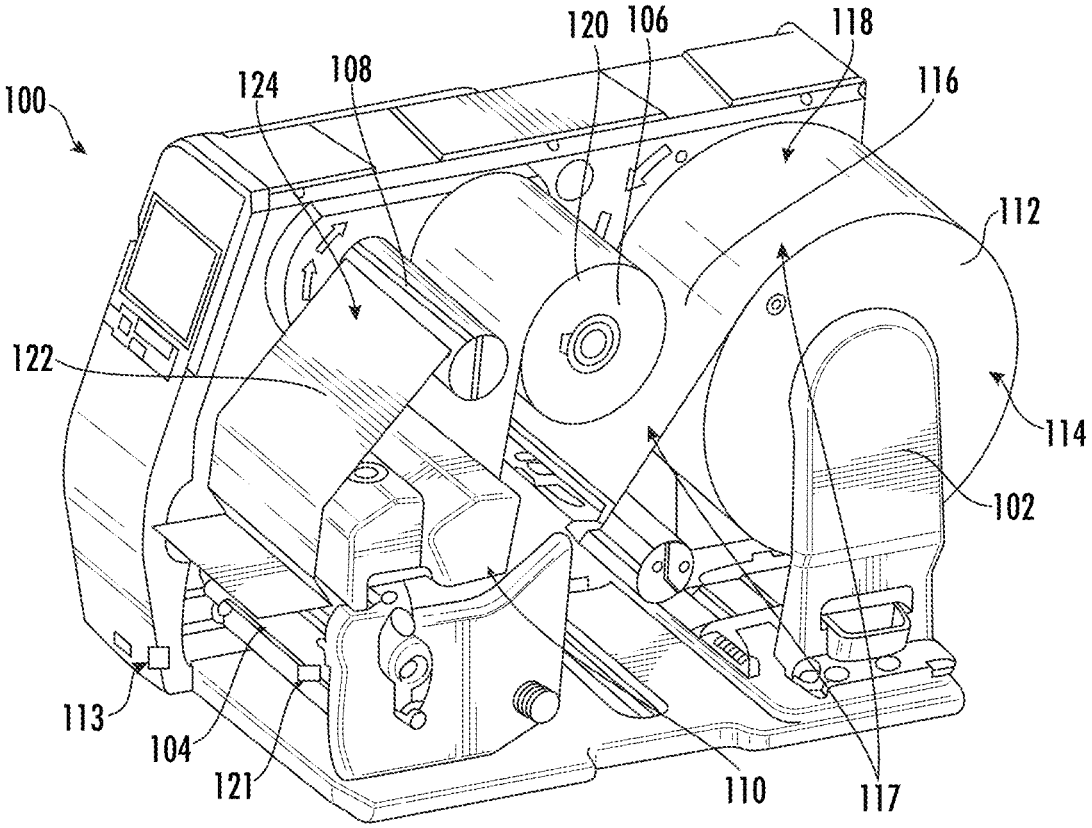
FIG. 1 illustrates a perspective view of a printer apparatus, according to one or more embodiments described herein.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such component or feature may be optionally included in some embodiments, or it may be excluded.

In various example embodiments, the term "media" is used herein to mean a printable medium, such as a page or a paper, with or without coated chemicals, on which content, such as graphics, text, and/or visual images, may be printed. The media may correspond to a continuous media that may be loaded in a printing apparatus in the form of a roll or a stack. In some embodiments, the scope of the disclosure is not limited to having a continuous media. In some embodiments, the media may be divided into a plurality of labels through perforations defined along a width of the media. In an embodiment, each label includes a top layer comprising a printing surface and a non-printing surface. The printing surface is used for printing content, such as graphics, text, visual images, etc., thereon. The non-printing surface of the label is bonded to an adhesive layer of the label. The adhesive layer is configured to bond the top layer of the label to a liner layer of the label. In an example implementation, the adhesive layer is in releasable contact with the liner layer of the label such that the liner layer may be removed from the top layer of the label to expose the adhesive layer that may be used to bond the label to a desired object.

In some alternative embodiments, the media may be divided into the plurality of labels by one or more marks at a defined distance from each other along the length of the media. In an example embodiment, a contiguous stretch of the media between two consecutive marks or two consecutive perforations corresponds to a label of a plurality of labels. In some examples, each of the plurality of labels includes a printable portion on which content may be printed using a printer apparatus. In some implementations, the printable portion on the label may correspond to the complete label. In such an implementation, the content is printable on the complete label. In another implementation, an area of the printable portion is less than the area of the label. In some embodiments, the media may correspond to a thermal media on which the content is printed on application of heat on the media itself. In alternative embodiments, the media may correspond to a liner media, a liner-less media, and/or the like.

A printing apparatus, such as a copier, a printer, a facsimile device or other systems, may be capable of reproducing content, visual images, graphics, texts, etc., on a page or a media. Some examples of the printing apparatus may include, but not limited to, thermal printers, inkjet printers, laser printers, and/or the like. In an embodiment, a printer apparatus is provided to print content on a printable portion of each label of the plurality of labels of the media. In an embodiment, each label comprises the adhesive layer on the non-printing surface of the label. In an example implementation, the adhesive layer is in releasable contact with a liner layer of the label. In an embodiment, the printer apparatus is provided to prevent contamination caused by adhesive leakage in the printer apparatus, which may be caused by adhesive oozing out from the adhesive layer of the label. For example, adhesive leakage may be caused by overheating of the labels while traversing along the media path of the printer apparatus. The overheating may be caused due to heat and/or pressure application in case of laser printers or thermal printers for printing content on the media. For example, in case of a laser printer, a label goes through preheating and subsequent heating in the printing process, which may force the adhesive in the adhesive layer of the label to soften by the heat application and ooze out. In another example, in case of a thermal printer, pressure is applied on a label by a platen roller of the thermal printer while the label is heated by a thermal printhead of the thermal printer, which results in the adhesive in the adhesive layer of the label to soften by the heat and pressure application and leak. In a printer apparatus which also comprises an optical verification unit, the adhesive leakage may contaminate a glass layer of the optical verification unit, thereby reducing scanning capabilities of the optical verification unit of the printer apparatus. In an embodiment, the printer apparatus provided herein avoids such adhesive leakage, thereby avoiding media jam in the printer apparatus, reducing maintenance costs, improving performance of the printer apparatus, and extending the operational lifespan of the printer apparatus.

A typical thermal printer includes a thermal printhead that has one or more heating elements. These heating elements may be individually or collectively energized to perform the printing operation. Examples of the thermal printers may include thermal transfer printers and direct thermal printers. Typically, in a thermal transfer printer, content is printed on the media by heating a coating of a ribbon so that the coating is transferred to the media. It contrasts with the direct thermal printing where no ribbon is present in the process. After the content is printed, the media is advanced along a media path to output the printed media from a printer media output defined in a housing of the printer apparatus. The outputted media may be torn automatically or manually using a tear bar.

A typical laser printer employs a laser (for example, a semiconductor laser) to project laser light onto an electrically charged, rotating cylindrical photoreceptor drum (also referred to a "printhead"). The laser light is suitably modulated (via printer electronics) in accordance with a rasterized image (and/or rasterized text) on a source document page. Photoconductivity on the photoreceptor drum allows the charged electrons to fall away from the areas exposed to light. Powdered ink (toner) particles are then electrostatically attracted to the charged areas of the photoreceptor drum that have not been laser-beamed. Media comprising a plurality of labels is passed through the laser printer by mechanical feed elements, such as paper guides/rollers along the media path where the media makes contact with the photoreceptor drum. The photoreceptor drum then transfers the image corresponding to content to be printed onto the media by direct contact. The media is passed onto a fuser, which uses intense heat to instantly fuse the toner/image onto the media to generate the printed media. After the content is printed, the media is advanced along the media path to output the printed media from a printer media output defined in a housing of the laser printer. The outputted media may be torn automatically or manually using a tear bar.

In various embodiments of the present invention, the printer apparatus includes a media hub that is configured to receive a media roll. The media roll corresponds to a roll of media that includes a plurality of labels. Each of the plurality of labels has a leading edge and a trailing edge. In some examples, the leading edge and the trailing edge of a label of the plurality of labels separate the label from the adjacent labels in the media. In some examples, the media hub causes the media to traverse along a media path. The printer apparatus further includes a printhead that is positioned adjacent to the media path. In an example embodiment, the printhead may be configured to print content on the media. For example, the printhead may be configured to print content on a first label of the plurality of labels. Post printing of the content on the first label, the media hub causes the media to advance along the media path to output the printed first label from the printer media output. Hereinafter, a direction of advancing of the media along the media path (for example, for printing and outputting the printed first label) is referred to as a print direction.

In an embodiment, the printer apparatus comprises a sensor unit positioned downstream of the printhead in the print direction. In an example implementation, the sensor unit corresponds to a thermal sensor unit such as, a thermocouple, a thermistor, an infrared photodiode, etc., configured to detect a temperature of a label of the plurality of labels comprising printed content. In another embodiment, the sensor unit is positioned upstream of the printhead in the print direction, such that the sensor unit detects a temperature of a non-printed label. In an embodiment, the sensor unit is configured to generate sensor signals indicative of the temperature of the label.

In an embodiment, the printer apparatus comprises a thermoelectric cooling assembly. In an embodiment, the thermoelectric cooling assembly is positioned downstream of the printhead in the print direction of the printer apparatus and proximate to the sensor unit. The thermoelectric cooling assembly is provided to control a temperature of a label of the plurality of labels of the media that comes in contact with the thermoelectric cooling assembly while traversing along the media path of the printer above the thermoelectric cooling assembly. In an embodiment, the thermoelectric cooling assembly comprises a thermoelectric cooling element and a base plate. In an embodiment, the thermoelectric cooling element comprises a first substrate, a second substrate, and a first plurality of semiconductor elements electrically coupled to a second plurality of semiconductor elements in the space between the first substrate and the second substrate. In an example implementation, the first plurality of semiconductor elements may correspond to N-type semiconductor elements and the second plurality of semiconductor elements may correspond to P-type semiconductor elements or vice versa. In an example embodiment, the first plurality of semiconductor elements and the second plurality of semiconductor elements are disposed in the space between the first substrate and the second substrate in an alternating series pattern.

In an embodiment, the base plate of the thermoelectric cooling assembly is electrically coupled to the first substrate of the thermoelectric cooling element and a heat sink unit of the thermoelectric cooling assembly is electrically coupled to the second substrate of the thermoelectric cooling element. In an embodiment, the first substrate of the thermoelectric cooling element, electrically coupled to the base plate, maintains the base plate at a first temperature for cooling the base plate in case temperature of a label in contact with the base plate is determined to be above a threshold temperature. In an example embodiment, the first temperature corresponds to a temperature range of about 10° C. to about 25° C. In some embodiments, the scope of the disclosure is not limited to the temperature range for the first temperature being limited to 10° C. to 25° C., but may vary depending on various factors such as a label type, surface characteristics of the label, etc., without departing from the scope of the disclosure. In an embodiment, excess heat from the first substrate is transferred to the second substrate for cooling the base plate. In an embodiment, the second substrate is configured to be maintained at a second temperature. In an embodiment, the thermoelectric cooling assembly comprises a heat sink configured to dissipate heat from the second substrate such that the second substrate is maintained at the second temperature. In an example embodiment, the second temperature corresponds to a temperature range of about 25° C. to about 40° C. In some embodiments, the scope of the disclosure is not limited to the temperature range for the second temperature being limited to 25° C. to 40° C., but may vary depending on various factors such as thermal resistance capacity of the second substrate, thermal resistance capacity of the heat sink unit, a label type, properties of adhesives used in the labels, etc., without departing from the scope of the disclosure.

In some embodiments, the printer apparatus further includes a media sensor. In some embodiments, the media sensor is configured to detect a position of the plurality of the labels on the media path. In some embodiments, the media sensor is configured to generate a signal indicative of a position of the plurality of labels on the media path. In some embodiments, the media sensor is positioned downstream of the printhead with respect to the print direction. In some embodiments, the media sensor is positioned between the printhead and the printer media output. In some embodiments, the media sensor is positioned proximate to the thermoelectric cooling assembly to identify a position of a label of the plurality of labels approaching the base plate of the thermoelectric cooling assembly while traversing along the media path. In such embodiments, the signal from the media sensor indicates proximity of the label to the sensor unit and generates a signal to trigger the sensor unit to detect a temperature of the label approaching the base plate of the thermoelectric cooling assembly while traversing along the media path, without departing from the scope of the disclosure.

In an example embodiment, the printer apparatus includes a processor that is communicatively coupled to sensor unit, the thermoelectric cooling assembly, the media sensor, and the printhead. In some implementations, the processor is configured to control various operations of the printer apparatus. For example, the processor may be configured to cause the printhead to print content on a label. After the content is printed on the label, the processor causes the media hub to facilitate traversal of the media in the print direction along the media path in order to output the printed label from the printer media output. In an embodiment, the processor causes the sensor unit to generate sensor signals indicative of a temperature of a label of the plurality of labels comprising the printed content that comes in contact with the thermoelectric cooling assembly. In an embodiment, the processor receives the sensor signals from the sensor unit. In an embodiment, the processor compares the temperature of the label of the plurality of labels with a threshold temperature. In an embodiment, in response to the comparison, the processor generates an output signal indicative of current supplied to the thermoelectric cooling assembly to adjust the temperature of the thermoelectric cooling assembly. In an embodiment, the output signal is indicative of the current supplied to the thermoelectric cooling element of the thermoelectric cooling assembly to maintain the first substrate of the thermoelectric cooling element at the first temperature for cooling the base plate of the thermoelectric cooling assembly. In another embodiment, the output signal is indicative of the current supplied to the thermoelectric cooling element of the thermoelectric cooling assembly to maintain the second substrate of the thermoelectric cooling element at the second temperature.

As a result, various embodiments of the present invention ensure that the temperature of the label of the plurality of labels of the media that comes in contact with the thermoelectric cooling assembly does not exceed the threshold temperature, thereby eliminating the possibility of adhesive leakage in the printer apparatus, and provide technical improvements over a conventional printer apparatus.

FIG. 1 illustrates a perspective view of a printer apparatus 100, according to one or more embodiments described herein. In an embodiment, the printer apparatus 100 is provided to prevent contamination caused by adhesive leakage in the printer apparatus 100. The printer apparatus 100 may include a media hub 102, a printer media output 104, a ribbon drive assembly 106, a ribbon take-up hub 108, a printhead 110, a thermoelectric cooling assembly, a sensor unit, and an optical verification unit housing 112.

In an example embodiment, the media hub 102 is configured to receive a media roll 114. In an example embodiment, the media roll 114 may correspond to a roll of a media 116 that may be a continuous media or may, in some example embodiments, include a plurality of labels 117 that are defined (in or on the media 116) by means of one or more perforations or one or more marks. In an example embodiment, the plurality of labels 117 in or on the media 116 may correspond to portions on which the printer apparatus 100 may be configured to print content.

In an example embodiment, the media hub 102 is coupled to a first electrical drive (not shown) that actuates the media hub 102. On actuation, the media hub 102 causes the media roll 114 to rotate, which further causes the media roll 114 to supply the media 116 comprising the plurality of labels 117 to the printhead 110 along a media path 118 in a print direction of the printer apparatus 100. In an embodiment, the printhead 110 is positioned adjacent to the media path 118 and downstream of the media hub 102 in the print direction and the printhead 110 prints content on the plurality of labels 117. In an example embodiment, along the media path 118, the media 116 traverses from the media roll 114 to the printhead 110, the optical verification unit housing 112, and the printer media output 104. In such an embodiment, the direction of the media traversal is referred to as the print direction. In some examples, the media hub 102 may be actuated in such a manner that the media 116 traverses in a direction opposite to the print direction. Hereinafter, the direction of the media traversal opposite to the print direction is referred to as the retract direction.

In some example embodiments, the scope of the disclosure is not limited to the media hub 102 facilitating supply of the media 116 along the media path 118. In alternative embodiment, the printer apparatus 100 may further include a platen roller, in addition to the media hub 102, that may be positioned along the media path 118. In such an embodiment, the platen roller may be coupled to the first electrical drive, which actuates the platen roller. On actuation, the platen roller may be configured to pull the media 116 from the media roll 114 (mounted on the media hub 102), causing the media 116 to traverse along the media path 118. In some embodiments, the first electrical drive may be coupled to both the platen roller and the media hub 102 such that both the platen roller and the media hub 102 operate in synchronization.

In an example embodiment, the printer media output 104 corresponds to a slot in a housing of the printer apparatus 100 through which the printed media (for example printed label) is outputted. The width of the printer media output 104 is in accordance with a width of the media 116. In some examples, the width of the printer media output 104 may correspond to a maximum width of the media 116 supported by the printer apparatus 100. At the printer media output 104, a media output sensor 121 is positioned.

The ribbon drive assembly 106 may receive a ribbon roll 120 that corresponds to a roll of a ribbon 122. In an example embodiment, the ribbon 122 may correspond to an ink media that is utilized to dispose ink onto the media 116 to print content on the media 116. In an example embodiment, the ribbon drive assembly 106 may be coupled to a second electrical drive that may be configured to actuate the ribbon drive assembly 106. On actuation of the ribbon drive assembly 106, the ribbon drive assembly 106 rotates, which causes the ribbon roll 120 to rotate and supply the ribbon 122 along a ribbon path 124. Along the ribbon path 124, the ribbon 122 traverses from the ribbon roll 120 to the printhead 110 and further to the ribbon take-up hub 108.

In an example embodiment, the ribbon take-up hub 108 may correspond to an assembly that may receive ribbon (i.e., a section of the ribbon 122 from which the ink has been is disposed on the media 116). The ribbon take-up hub 108 may also be coupled to a third electrical drive that may be configured to actuate the ribbon take-up hub 108. On actuation, the ribbon take-up hub 108 pulls the ribbon 122 from the ribbon roll 120. In some examples, the second electrical drive and the third electrical drive may operate in synchronization such that an amount of ribbon 122 released by the ribbon roll 120 (due to actuation of the second electrical drive) is equal to the amount of ribbon 122 received by the ribbon take-up hub 108.

The printhead 110 may correspond to a component that is configured to print the content on the media 116. In an example embodiment, the printhead 110 may include a plurality of heating elements (not shown) that are energized and pressed against the ribbon 122 to perform a print operation. In operation, the printhead 110 applies heat on the section of the ribbon 122 and, concurrently, presses the ribbon 122 against the media 116 to transfer the ink on the media 116. To press the ribbon 122 against the media 116, the printhead 110 travels in a vertically downward direction (or downward direction) to push the ribbon 122 against the media 116. In embodiments where the media 116 corresponds to a thermal paper, the printhead 110 may be directly press against the thermal paper to perform the print operation.

During the print operation, one or more heating elements of the plurality of heating elements are energized to perform the print operation. The one or more heating elements may be selected based on the data in a print job. For example, if a letter "A" is to be printed, the one or more heating elements that are energized are positioned on the printhead 110 in such a manner that when the printhead 110 is pressed against the ribbon 122 and the media 116, letter "A" gets printed on the media 116.

In an example embodiment, after the print operation, the media 116 and the ribbon 122 traverse along the media path 118 and the ribbon path 124, respectively, such that the printed media 116 traverses along the media path 118 below the optical verification unit housing 112. The optical verification unit housing 112 may include an optical verification unit (further described in FIG. 4) that is configured to capture an image of the printed content. Based on the image of the printed content, the printer apparatus 100 may be configured to verify the printed content (i.e. determine whether the printed content is acceptable), as is further described in conjunction with FIG. 5. In some examples, the verification of the printed content may enable the printer apparatus 100 to perform various operations such as, but not limited to, correcting the printed content and/or detecting an error in printed. The structure of the optical verification unit housing 112 is described later in conjunction with FIG. 5.

In an example embodiment, after the verification of the printed content, the printed media is outputted from the printer media output 104. In an example embodiment, the media 116 traverses in the print direction along the media path 118 to output the printed media from the printer media output 104.

In an embodiment, the printer apparatus 100 comprises the sensor unit positioned downstream of the printhead 110 in the print direction. The structure of the sensor unit is described later in conjunction with FIG. 4. In an embodiment, the sensor unit is configured to generate sensor signals indicative of the temperature of the label 117. In an example embodiment, the sensor unit is located within the optical verification unit housing 112 such that the sensor unit is between the printhead 110 and the optical verification unit. In alternative embodiment, the sensor unit may not be located within the optical verification unit housing 112. In such an embodiment, the sensor unit may be positioned outside the optical verification unit housing 112 but between the printhead 110 and the optical verification unit, without departing from the scope of the disclosure.

In an embodiment, the printer apparatus 100 comprises the thermoelectric cooling assembly. The structure of the thermoelectric cooling assembly is described later in conjunction with FIGS. 2-3. In an embodiment, the thermoelectric cooling assembly is positioned downstream of the printhead 110 in the print direction and proximate to the sensor unit, such that the printed media 116 traverses along the media path 118 above the thermoelectric cooling assembly. In another embodiment, the thermoelectric cooling assembly is positioned upstream of the printhead 110 in the print direction and proximate to the sensor unit, such that non-printed media 116 traverses along the media path 118 above the thermoelectric cooling assembly. For example, in case of the printer apparatus 100 corresponding to a laser printer, the thermoelectric cooling assembly is positioned upstream of a printhead of the laser printer in the print direction and proximate to the sensor unit, such that the non-printed media 116 traverses along the media path 118 above the thermoelectric cooling assembly to allow the thermoelectric cooling assembly to control of a temperature of a label 117 of the plurality of labels 117 of the media 116 that comes in contact with the thermoelectric cooling assembly, thereby facilitating preheating of the media in the laser printer.

Figure 2:
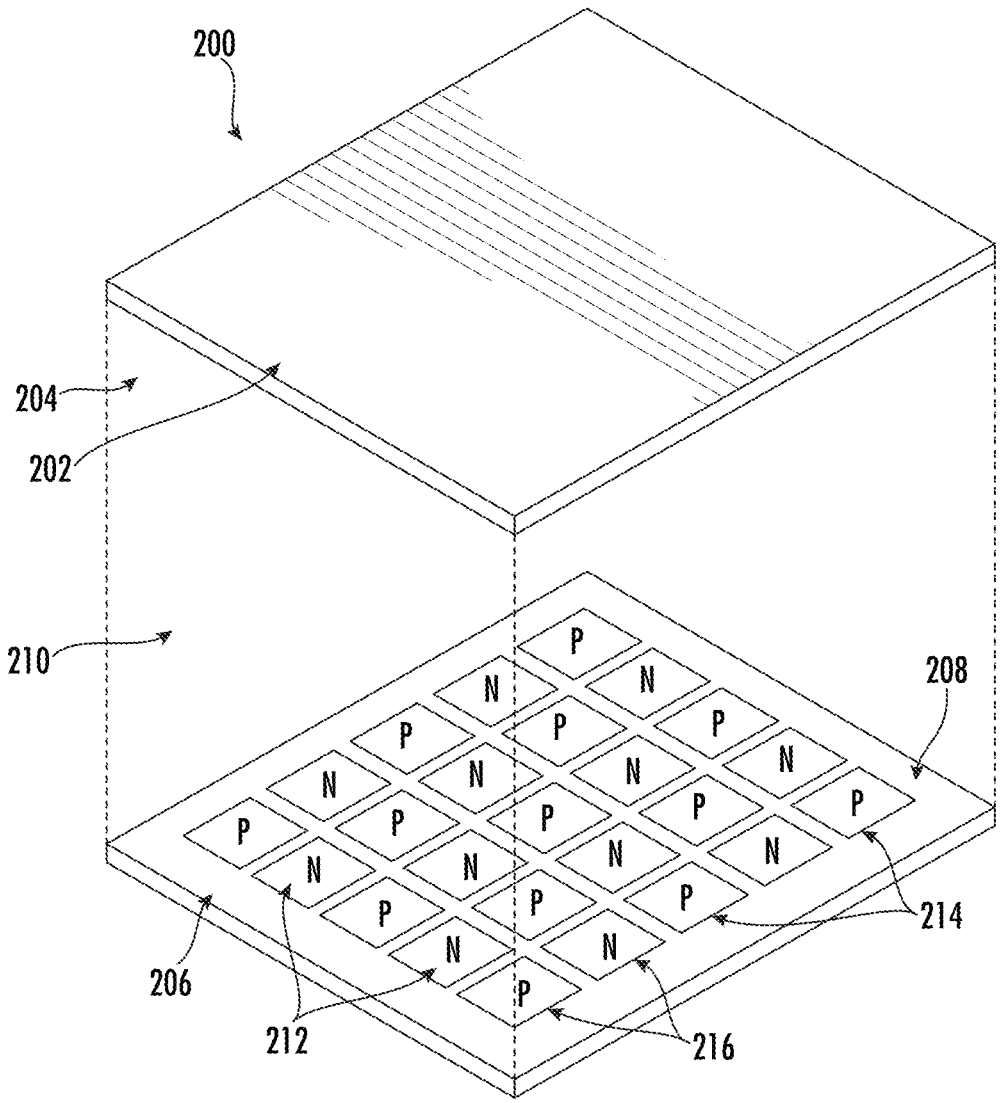
FIG. 2 illustrates a perspective view of a thermoelectric cooling element, according to one or more embodiments described herein.
Figure 3:
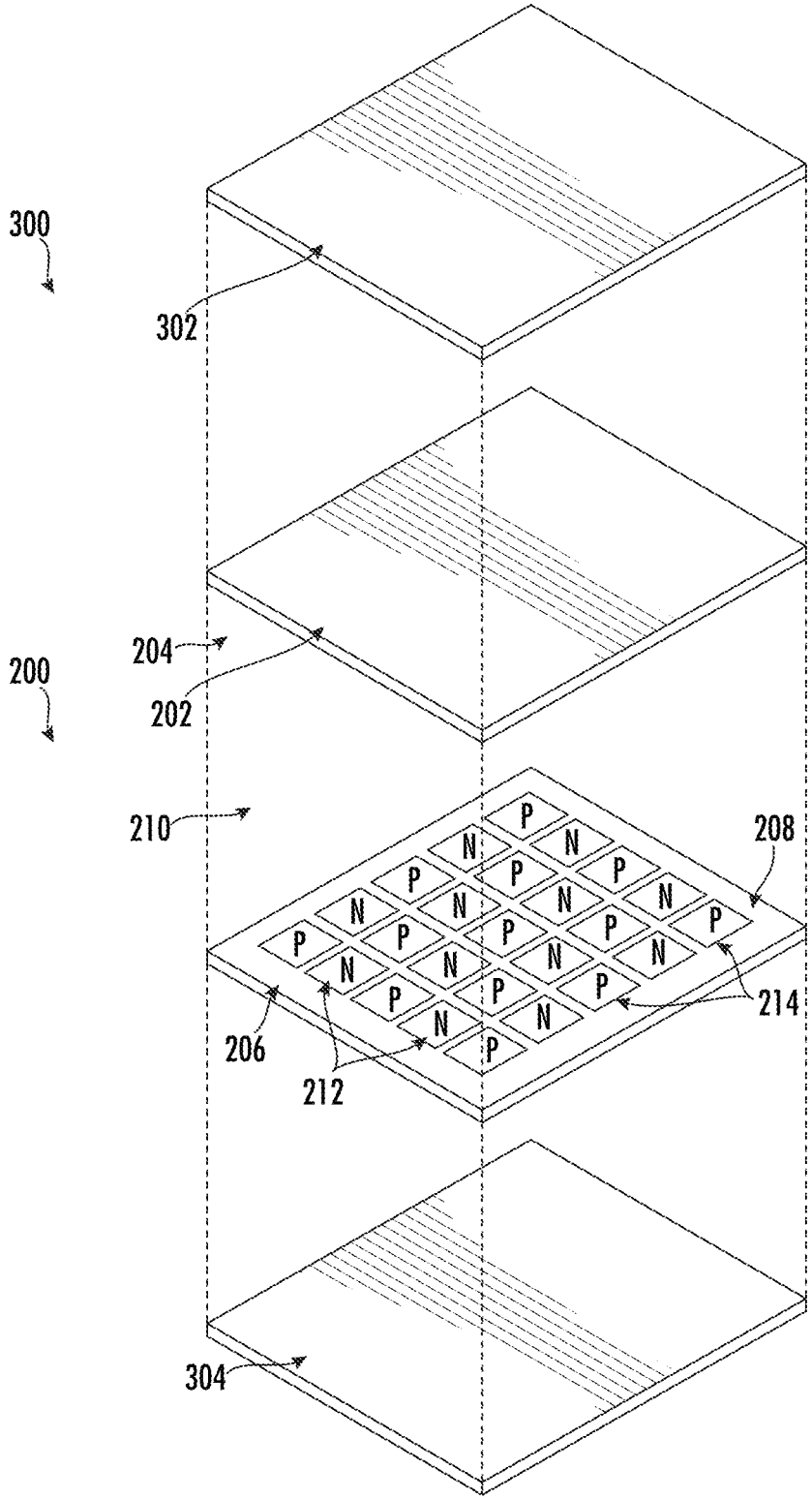
FIG. 3 illustrates a perspective view of a thermoelectric cooling assembly, according to one or more embodiments described herein.

In an embodiment, the thermoelectric cooling assembly comprises the thermoelectric cooling element and the base plate (further described in FIGS. 2-3). In an embodiment, the thermoelectric cooling assembly is provided to control a temperature of a label 117 of the plurality of labels 117 of the media 116 that comes in contact with the thermoelectric cooling assembly while traversing along the media path 118 of the printer apparatus 100 above the thermoelectric cooling assembly, as is further described in conjunction with FIGS. 2 and 3). In an embodiment, the thermoelectric cooling assembly is housed in the optical verification unit housing 112. However, the scope of the disclosure is not limited to the thermoelectric cooling assembly being housed in the optical verification unit housing 112, but may also comprise positioning the thermoelectric cooling assembly at any location between the optical verification unit and the printhead 110, without departing from the scope of the disclosure.

In some examples, the printer apparatus 100 may further include a cover (not shown) that may be configured to conceal the various components of the printer apparatus 100 (including, for example, the media hub 102, the printer media output 104, the ribbon drive assembly 106, the ribbon take-up hub 108, the printhead 110, the thermoelectric cooling assembly, the sensor unit, and the optical verification unit housing 112, and the printer cover sensor 113). In some examples, where the media roll 114 is to be changed, a user of the printer apparatus 100 may remove the cover to change the media roll 114. In such an example, the removal of the cover needs to be detected so that the operation of the printer apparatus 100 is halted for safety of the user. Therefore, to detect the removal of the cover, the printer apparatus 100 may include the printer cover sensor 113. The printer cover sensor 113 may include suitable logic and/or circuitry that may be configured to detect whether the cover of the printer apparatus 100 has been removed or opened. In some examples, the printer cover sensor 113 may correspond to a button provided on the housing of the printer apparatus 100, which is pressed when the cover is attached to the printer apparatus 100 (hereinafter referred to as pressed state). In some examples, the printer cover sensor 113 may be configured to generate a signal when the printer cover sensor 113 is in pressed state. When the cover is removed from the printer apparatus 100, the button is released (hereinafter referred to as released state). In some examples, the printer cover sensor 113 may be configured to halt generation of the signals and operation of the printer apparatus 100 when the printer cover sensor 113 is in the released state.

In an embodiment, the printer apparatus 100 further comprises electrical and drive components that may include a stepper motor (not shown) of a stepper motor assembly, an electronic circuitry (not shown), and an electric drive assembly (not shown). The electronic circuitry may include one or more circuit boards (not shown), which may be installed in the printer apparatus 100 by sliding the circuit boards through an opening (not shown), formed in the casing of the printer apparatus 100. The circuit boards may be chosen to suit a specific printing operation to be performed. For example, the electronic circuitry may be changed for different communications interfaces. Alternatively, software can be downloaded via a mechanism, such as COM port or CUPS printer driver, to control a specific printing application.

The stepper motor in the stepper motor assembly may be configured to actuate the electrical drives, such as the first, the second, and/or the third electrical drives of various other assemblies as described above, and also a media drive (not shown), thereby controlling the traversal of the media 116 in the print direction and the retract direction. For example, in an example embodiment, the actuation of the stepper motor further actuates the first electrical drive that causes the media hub 102 to rotate, which in turn causes the media roll 114 to supply the media 116 along the media path 118. In an example embodiment, the actuation of the stepper motor further actuates the second electrical drive that causes ribbon drive assembly 106 to rotate and supply the ribbon 122 along the ribbon path 124. In an example embodiment, the actuation of the stepper motor further actuates the third electrical drive that may be configured to actuate the ribbon take-up hub 108.

In some examples, the scope of the disclosure is not limited to having a single stepper motor in the printer apparatus 100. In an example embodiment, the printer apparatus 100 may include more than one stepper motor. For example, the printer apparatus 100 may include individual stepper motor(s) for each of the first electrical drive, the second electrical drive and the third electrical drive.

FIG. 1 depicts the printer apparatus 100 as the thermal transfer printer. In some embodiments, the scope of the disclosure is not limited to the printer apparatus 100 being a thermal transfer printer. In alternate embodiments, the printer apparatus 100 may correspond to a direct thermal or laser printer.

FIG. 2 exemplarily illustrates a perspective view of the thermoelectric cooling element 200, according to one or more embodiments described herein. In an embodiment, the printer apparatus 100 comprises the thermoelectric cooling assembly comprising the thermoelectric cooling element 200. As used herein, the phrase "thermoelectric cooling element" refers to a semiconductor device that is configured to exhibit the thermoelectric effect. As per the thermoelectric effect, a temperature differential is created between junctions of N-type semiconductor elements and P-type semiconductor elements of the thermoelectric cooling element 200 when a direct current (DC) is applied across the junctions of the N-type semiconductor elements and the P-type semiconductor elements, thereby causing the thermoelectric cooling element 200 to act as a cooler or a heater based on the direction of the applied DC current. For example, as the DC current flows through the junctions 216 of the N-type semiconductor elements and the P-type semiconductor elements, the thermoelectric cooling effect takes effect to lower the temperature of one side referred to as the cold side of the thermoelectric cooling element 200. Correspondingly, the temperature of the other side of the thermoelectric cooling element 200 referred to as the hot side of the thermoelectric cooling element 200 increases, as heat from the cold side is transferred to the hot side. The temperatures of both sides of the thermoelectric cooling element 200 may be reversed by reversing the direction of the DC current.

In an example embodiment, the size of the thermoelectric cooling element 200 may range from 14 mm by 14 mm, 14 mm by 15 mm, 15 mm by 15 mm, 15 mm by 20 mm, etc., based on the cooling requirement of the printer apparatus 100 to prevent adhesive leakage in the printer apparatus 100. For example, larger the size of the thermoelectric cooling element 200 or more the number of thermoelectric cooling elements 200 in the thermoelectric cooling assembly, faster cooling effect may be achieved in the printer apparatus 100.

In an embodiment, the thermoelectric cooling element 200 comprises a first substrate 202 and a second substrate 206. In an embodiment, the first substrate 202 and the second substrate 206 may be made of electrical insulator materials to provide electrical insulation to other parts or structures of the printer apparatus 100 that may come in contact with the thermoelectric cooling element 200 while allowing heat conduction through the first substrate 202 and the second substrate 206 to facilitate the thermoelectric effect to take place. For example, the first substrate 202 and the second substrate 206 may be made of ceramic, epoxy, silicon, etc.

In an embodiment, a first peripheral surface 204 of the first substrate 202 is configured to be positioned opposing a second peripheral surface 208 of the second substrate 206, as exemplarily illustrated in FIG. 2. As used herein, the phrase "peripheral surface" refers to a planar surface of a substrate defined about the edges of the substrate. For example, the four edges of the first substrate 202 define the first peripheral surface 204 and the four edges of the second substrate 206 define the second peripheral surface 208 such that the first peripheral surface 204 of the first substrate 202 is positioned opposite to the second peripheral surface 208 of the second substrate 206. In an embodiment, the second substrate 206 is separated from the first substrate 202 by a space 210 therebetween, as exemplarily illustrated in FIG. 2.

In an embodiment, the thermoelectric cooling element 200 comprises a first plurality of semiconductor elements 212 electrically coupled to a second plurality of semiconductor elements 214. In an embodiment, the first plurality of semiconductor elements 212 is electrically coupled to the second plurality of semiconductor elements 214 in the space 210 defined between the first substrate 202 and the second substrate 206. In an example embodiment, the first plurality of semiconductor elements 212 and the second plurality of semiconductor elements 214 are disposed in the space 210 between the first substrate 202 and the second substrate 206 in an alternating series pattern, as exemplarily illustrated in FIG. 2.

In an example implementation, the first plurality of semiconductor elements 212 may correspond to N-type semiconductor elements and the second plurality of semiconductor elements 214 may correspond to P-type semiconductor elements. The N-type semiconductor elements are made of a semiconductor material that has excess of electrons. For example, the N-type semiconductor elements may be made of Phosphorus, Arsenic, Antimony, etc. The P-type semiconductor elements are made of a semiconductor material that has deficit of electrons. For example, the P-type semiconductor elements may be made of Boron, Aluminium, Gallium, etc. In another example implementation, the first plurality of semiconductor elements 212 may correspond to P-type semiconductor elements and the second plurality of semiconductor elements 214 may correspond to N-type semiconductor elements.

In an embodiment, the thermoelectric cooling element 200 further comprises two electrodes (not shown) for facilitating the flow of DC current through the junctions 216 of the first plurality of semiconductor elements 212 and the second plurality of semiconductor elements 214 to effectuate the thermoelectric effect.

In an embodiment, the first substrate 202 is maintained at a first temperature and the second substrate 206 is maintained at a second temperature. In an example embodiment, the first temperature corresponds to a temperature range of about 10° C. to about 20° C. and the second temperature corresponds to a temperature range of about 20° C. to about 40° C., without departing from the scope of the disclosure. In an example implementation, the first substrate 202 is maintained at the first temperature such that the first substrate 202 is defined as the cool side of the thermoelectric cooling element 200 and the second substrate 206 is maintained at the second temperature such that the second substrate 206 is defined as the hot side of the thermoelectric cooling element 200.

FIG. 3 illustrates a perspective view of the thermoelectric cooling assembly 300, according to one or more embodiments described herein. In an embodiment, the thermoelectric cooling assembly 300 is configured to control a temperature of a label 117 of the plurality of labels 117 of the media 116 that comes in contact with the thermoelectric cooling assembly 300. In an embodiment, the label 117 may come in contact with the thermoelectric cooling assembly 300 while the media 116 is traversing along the media path 118 of the printer apparatus 100 above the thermoelectric cooling assembly 300.

As exemplarily illustrated in FIG. 3, the thermoelectric cooling assembly 300 comprises the thermoelectric cooling element 200 and the base plate 302. The structures and functions of the thermoelectric cooling element 200 are described in conjunction with FIG. 2.

In an embodiment, the base plate 302 is configured to be electrically coupled to the first substrate 202 of the thermoelectric cooling element 200. In an embodiment, the base plate 302 may be made of an electrical insulator material to provide electrical insulation to other parts or structures of the printer apparatus 100 that may come in contact with the base plate 302 of the thermoelectric cooling assembly 300. In an embodiment, the material of the base plate 302 has high thermal conductivity and is configured to allow heat conduction through the first substrate 202 of the thermoelectric cooling element 200 to the label 117 that comes in contact with the base plate 302 while the media 116 traverses along the media path 118 above the thermoelectric cooling assembly 300. For example, when a temperature of a label 117 is detected to be above a predetermined threshold temperature which may cause an adhesive layer of the label 117 to leak, the material of the base plate 302 allows the first substrate 202 of the thermoelectric cooling element 200 that is at the first temperature (i.e. cooler temperature in comparison to an ambient temperature of the printer apparatus 100) to reduce the temperature of the label 117 that comes in contact with the base plate 302 of the thermoelectric cooling assembly 300. In an example implementation, the material of the base plate 302 may be made of steel, stainless steel, aluminum, bronze, metal alloys, etc.)

In an embodiment, the base plate 302 is configured to be proximate to the plurality of labels 117 of the media 116 traversing along the media path 118 of the printer apparatus 100 above the thermoelectric cooling assembly 300. In some embodiments, each label 117 of the plurality of labels 117 come in contact with the base plate 302 when traversing along the media path 118 above the thermoelectric cooling assembly 300. In some other embodiments, every alternate label 117 of the plurality of labels 117 come in contact with the base plate 302 when traversing along the media path 118 above the thermoelectric cooling assembly 300. In some other embodiments, any label 117 of the plurality of labels 117, in a sequential or a non-sequential order comes in contact with the base plate 302 when traversing along the media path 118 above the thermoelectric cooling assembly 300.

In an embodiment, the thermoelectric cooling assembly 300 further comprises the heat sink unit 304. In an embodiment, the heat sink unit 304 is electrically coupled to the second substrate 206 of the thermoelectric cooling element 200. In an embodiment, the heat sink unit 304 is electrically coupled to the second substrate 206 to dissipate heat from the second substrate 206, thereby maintaining the second substrate 206 at the second temperature. In an embodiment, the heat sink unit 304 is electrically coupled to the second substrate 206 by using conventional adhesives or mechanical fasteners. In an embodiment, excess heat generated at the second substrate 206 of the thermoelectric cooling element 200 due to the thermoelectric effect of the thermoelectric cooling element 200 is extracted from the second substrate 206 by the heat sink unit 304. In an embodiment, the heat sink unit 304 may further dissipate the extracted excess heat into the ambient environment outside the printer apparatus 100 by using heat radiating convection fins defined on the cover of the printer apparatus 100, forced convection mechanism to allow forced air flow, or other conventional liquid, gas, or thermal transfer mechanisms, micro cooling heat pipes, etc.

Figure 4:
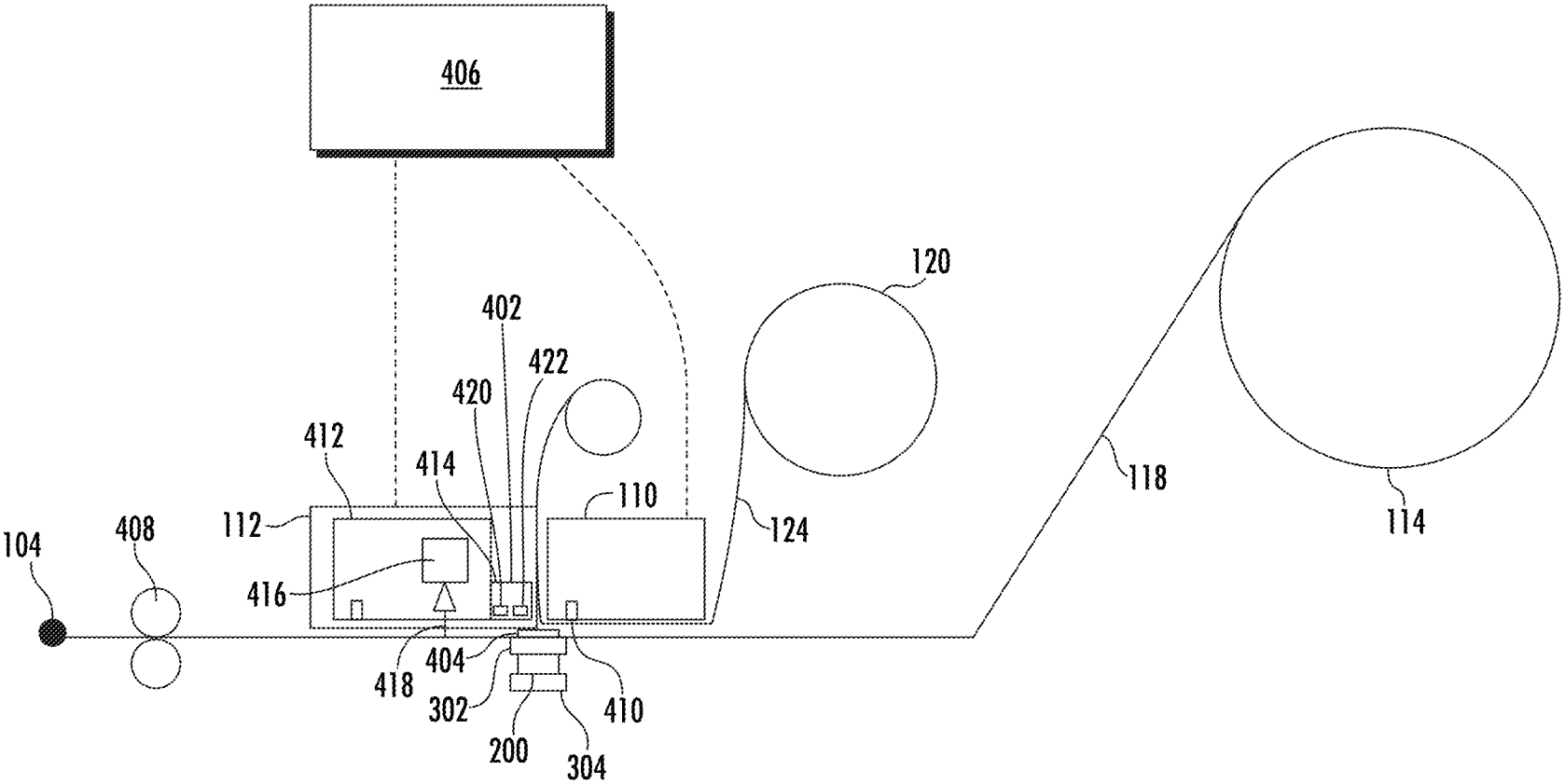
FIG. 4 illustrates schematics of the printer apparatus, according to one or more embodiments described herein.

FIG. 4 illustrates schematics of the printer apparatus 100, according to one or more embodiments described herein. As illustrated, the printer apparatus 100 further includes a media sensor 402, a control system 406, the thermoelectric cooling assembly 300, the optical verification unit 416, and a platen roller 408. The schematic of the printer apparatus 100 further depicts the media path 118, and the ribbon path 124. Furthermore, the schematic of the printer apparatus 100 depicts that the printhead 110 is positioned downstream of the media roll 114 in the print direction, and downstream of the ribbon roll 120 along the ribbon path 124. In an example embodiment, the printhead 110 is positioned on top of both the ribbon path 124 and the media path 118.

During the print operation, the printhead 110 moves in a vertically downward direction (orthogonal to the print direction) to press the ribbon 122 against the media 116 to perform the print operation. More specifically, the printhead 110 includes a burn line 410 that heats the section of the ribbon 122 (while the ribbon 122 is pressed against the media 116) to perform the print operation. In some examples, the burn line 410 includes the plurality of heating elements that are heated to perform the print operation. During the print operation, the heat subjected to the plurality of labels 117 of the media 116 by the plurality of heating elements of the printhead 110 may cause leakage of adhesive from the adhesive layer of respective labels 117.

Although the printer apparatus 100 is described herein with reference to a thermal transfer printer, it is understood that the invention is not to be limited to the specific embodiments disclosed herein and that modifications and other embodiments are intended to be included within the scope of the appended claims. In some example embodiments, the scope of the disclosure may comprise the printer apparatus 100 corresponding to a direct thermal printer apparatus (not shown) that is used to produce printed content on the media 116 comprising the plurality of labels 117. In such an embodiment, the labels 117 comprise thermally sensitive coating. The printhead of the direct thermal printer generates heat and selectively applies the heat to the thermally sensitive coated media as it passes over the printhead. The labels 117 change color to black where the heat is applied by the printhead. An image is produced where the label's coating turns black in the areas where it is heated, thereby printing the content on the labels 117 of the media 116. During the print operation performed by the direct thermal printer apparatus, the heat subjected to the plurality of labels 117 of the media 116 by the printhead may cause leakage of adhesive from the adhesive layer of respective labels 117.

In an embodiment, another scenario that results in adhesive leakage from the plurality of labels 117 of the media 116 corresponds to pressure applied by the platen roller of the printer apparatus 100. In an example embodiment, the platen roller 408 is positioned downstream of the printhead 110 along the media path 118 with respect to the print direction. As described above, the platen roller 408 may be coupled to the first electrical drive that enables the platen roller 408 to rotate and pull the media 116 from the media roll 114, and accordingly cause the media 116 to traverse along the media path 118. The pressure applied by the platen roller on the media 116 may further attribute to the adhesive leakage in the plurality of labels 117 of the media 116 while the media 116 traverses along the media path 118 via the platen roller.

Further, the schematic of the printer apparatus 100 further depicts the optical verification unit housing 112 positioned downstream of the printhead 110 with respect to the print direction. In an embodiment, the optical verification unit 416 housed in the optical verification unit housing 112 is positioned downstream of the printhead 110 in the print direction. In an embodiment, the optical verification unit 416 is configured to capture an image of the media 116 traversing along the media path 118 of the printer apparatus 100 below the optical verification unit 416. In an example embodiment, the optical verification unit housing 112 includes a first housing portion 412 and a second housing portion 414. In some examples, the second housing portion 414 is closer to the printhead 110 compared to the first housing portion 412. In an example embodiment, the first housing portion 412 includes an optical verification unit 416, while the second housing portion 414 includes the media sensor 402.

In some example embodiments, the optical verification unit 416 may include a lens assembly (not shown) and a sensor assembly (not shown). In an example embodiment, the sensor assembly in the optical verification unit 416 may facilitate the optical verification unit 416 to capture an image of the printed media 116 within the field of view of the optical verification unit 416. In some examples, the sensor assembly may correspond to a CMOS sensor and/or CCD sensor. In an example embodiment, the field of view of the optical verification unit 416 is depicted by the numeral 418. Hereinafter, the field of view of the optical verification unit 416 is referred to as a verifier scan line 418.

In an example embodiment, the media sensor 402 may correspond to a sensor that is configured to detect a presence of the media 116 on the media path 118. In some example embodiments, the media sensor 402 may be configured to detect the presence of the media 116 by determining transmissivity and/or reflectivity of the media 116. In an example embodiment, the transmissivity of the media 116 may correspond to a measurement of an intensity of a light signal that the media 116 allows to pass through it. In an example embodiment, the reflectivity of the media 116 may correspond to a measurement of an intensity of light signal that gets reflected from a surface of the media 116.

In some example embodiments, the media sensor 402 includes a light transmitter 420 and a light receiver 422. The light transmitter 420 may correspond to a light source, such as a Light Emitting Diode (LED), a LASER, and/or the like. The light transmitter 420 may be configured to direct the light signal on the media path 118. The light receiver 422 may correspond to at least one of a photodetector, a photodiode, or a photo resistor. The light receiver 422 may generate a signal based on an intensity of the light signal received by the light receiver 422. In an example embodiment, the signal may correspond to a voltage signal, where the one or more characteristics of the voltage signal (such as the amplitude of the voltage signal and the frequency of the voltage signal) are directly proportional or inversely proportional to the intensity of the portion of the light signal received by the media sensor 402.

In an embodiment, the light transmitter 420 of the media sensor 402 may be configured to direct the light signal on the media path 118. If the media 116 is present on the media path 118, a portion of light signal may get reflected from the surface of the media 116. The light receiver 422 may receive the portion of the light signal. Based on the intensity of the portion of the light signal, the light receiver 422 is configured to generate the signal. Because the intensity of the portion of the light signal reflected from the surface of the media 116 is dependent on the reflectivity of the media 116, the signal generated by the media sensor 402 (based on the intensity of the portion of the light signal) is indicative of a measurement of the reflectivity of the media 116.

In an embodiment, the media sensor 402 may be configured to determine the transmissivity of the media 116. To determine the transmissivity of the media 116, the light receiver 422 may receive the portion of the light signal that passes through the media 116. To receive the portion of the light signal that passes through the media 116, the light receiver 422 is spaced apart from the light transmitter 420 in such a manner that the media 116 passes through a space between the light receiver 422 and the light transmitter 420. When the light transmitter 420 directs the light signal on the media 116, the portion of the light signal passes through the media 116 is receivable by the light receiver 422. The light receiver 422 may generate the signal in accordance with the measured intensity of the portion of light signal received. Because the intensity of the portion of the light signal that passes through the media 116 is dependent on the transmissivity of the media 116, the signal generated by the media sensor 402 (based on the intensity of the portion of the light signal) is indicative of a measurement of the transmissivity of the media 116.

In an example embodiment, the media sensor 402 is located within the optical verification unit housing 112 such that the media sensor 402 is between the printhead 110 and the optical verification unit 416. In alternative embodiment, the media sensor 402 may not be located within the optical verification unit housing 112. In such an embodiment, the media sensor 402 may be positioned outside the optical verification unit housing 112 but between the printhead 110 and the optical verification unit 416, without departing from the scope of the disclosure.

In an example embodiment, the media sensor 402 may be utilized to detect a position of the plurality of labels 117 on the media path 118. For example, when a label 117 of the plurality of labels 117 traverses past the printhead 110 and/or approaches the optical verification unit 416 along the media path 118, the media sensor 402 may detect the position of the label 117. In an embodiment, the thermoelectric cooling assembly 300 is configured to be positioned between the optical verification unit 416 and the printhead 110. In such embodiments, where the thermoelectric cooling assembly 300 is positioned between the optical verification unit 416 and the printhead 110, the media sensor 402 may detect when the label 117 is positioned above the base plate 302 of the thermoelectric cooling assembly 300.

In an embodiment, the printer apparatus 100 further comprises the sensor unit 404. In an embodiment, the sensor unit 404 is configured to be positioned downstream of the printhead 110 in the print direction and proximate to the thermoelectric cooling assembly 300. In an example implementation, the sensor unit 404 corresponds to a thermal sensor unit such as, a thermocouple, a thermistor, an infrared photodiode, etc., configured to detect a temperature of a label 117 of the plurality of labels 117 comprising printed content. In an embodiment, the sensor unit 404 is configured to generate sensor signals indicative of the temperature of the label 117 that comes in contact with the thermoelectric cooling assembly 300 while traversing along the media path 118 above the thermoelectric cooling assembly 300.

In another embodiment, the sensor unit 404 is configured to detect a temperature of a label 117 of the plurality of labels 117 before being subjected to the printing operation. In this embodiment, the sensor unit 404 detects the temperature of the label 117 before being subjected to the printing operation such that the thermoelectric cooling assembly 300 facilitates preheating of the label 117 before the printing operation. For example, in case of the printer apparatus 100 corresponding to a laser printer, the thermoelectric cooling assembly 300 is positioned upstream of a printhead of the laser printer in the print direction and proximate to the sensor unit 404, such that non-printed media 116 traverses along the media path 118 above the thermoelectric cooling assembly 300 to allow the thermoelectric cooling assembly 300 to control of the temperature of the label 117 that comes in contact with the thermoelectric cooling assembly 300, thereby facilitating preheating of the non-printed media 116 in the laser printer.

In this example embodiment, the sensor unit 404 generates sensor signals indicative of the temperature of the label 117 that comes in contact with the thermoelectric cooling assembly 300 before being subjected to the printing operation by the printhead of the laser printer. The sensor signals indicative of the temperature of the label 117 facilitate controlling the temperature of the label 117, thereby facilitating controlling a quantum of preheat current required to preheat the label 117 before being subjected to the printing operation of the laser printer. For example, when the sensor unit 404 detects that the temperature of the label 117 is below a predetermined temperature for the label 117 that is required to print content on the label 117 by the printhead of the laser printer, the current supplied to the thermoelectric cooling element 200 of the thermoelectric cooling assembly 300 is increased to bring the temperature of the label 117 to the predetermined temperature required for the preheating of the label 117. In another example, when the temperature of the label 117 is above the predetermined temperature required for preheating the label 117, the current supplied to the thermoelectric cooling element 200 of the thermoelectric cooling assembly 300 is decreased to bring the temperature of the label 117 to the predetermined temperature required for the preheating of the label 117. Hence, the thermoelectric cooling assembly 300 in the laser printer controls the temperature of the label 117 of the plurality of labels 117 of the media 116 based on the predetermined temperature required for preheating the label 117 for the printing operation by the laser printer, thereby eliminating the need of additional preheating elements in the laser printer.

In an embodiment, the thermoelectric cooling assembly 300 is positioned downstream of the printhead 110 in the print direction of the printer apparatus 100. In an embodiment, as exemplarily illustrated in FIG. 4, the thermoelectric cooling assembly 300 is positioned between the optical verification unit 416 and the printhead 110. The structure and functions of the thermoelectric cooling assembly 300 are described in conjunction with FIG. 3. In an embodiment, the base plate 302 of the thermoelectric cooling assembly 300 is positioned proximate to the plurality of labels 117 of the media 116 traversing along the media path 118 of the printer apparatus 100 above the thermoelectric cooling assembly 300, such that one or more labels 117 of the plurality of labels 117 that traverse towards the optical verification unit 416 after being subjected to heat application by the printhead 110 are detected at the base plate 302 of the thermoelectric cooling assembly 300.

The printer apparatus 100 further includes a control system 406 that includes suitable logic and circuitry to control the operation of the printer apparatus 100. For example, the control system 406 may be configured to control the operation of one or more components of the printer apparatus 100 to control the operation of the printer apparatus 100. For example, the control system 406 may be configured to control the heating/energization of the plurality of heating elements in the printhead 110 to execute the print job. For example, the control system 406 may be configured to control the operation of the optical verification unit 416. Further, the control system 406 may be communicatively coupled with the media sensor 402, the first electrical drive, the second electrical drive, and the third electrical drive. The structure of the control system 406 is further described in conjunction with FIG. 6.

Further, the control system 406 may be communicatively coupled with the thermoelectric cooling assembly 300 to control the operation of the thermoelectric cooling assembly 300. In an embodiment, the control system receives, from the sensor unit 404, the sensor signals indicative of a temperature of a label 117 of the plurality of labels 117 of the media 116 that comes in contact with the thermoelectric cooling assembly 300. In an example implementation, the control system receives the sensor signals indicative of the temperature of the label 117 that comes in contact with the base plate 302 of the thermoelectric cooling assembly 300. The control system compares the temperature of the label 117 with a threshold temperature. In an embodiment, the threshold temperature is determined based on, for example, surface characteristics of the media 116, a type of an adhesive layer of the label 117, a type of the base plate 302 of the thermoelectric cooling assembly 300, a type of the thermoelectric cooling element 200 of the thermoelectric cooling assembly 300, a print speed of the printer apparatus 100, ambient temperature associated with the printer apparatus 100, etc.

In response to the comparison, the control system is configured to generate an output signal indicative of current supplied to the thermoelectric cooling element 200 of the thermoelectric cooling assembly 300 to adjust the temperature of the thermoelectric cooling element 200. In an embodiment, the output signal generated by the control system may be indicative of the current supplied to the thermoelectric cooling element 200 to maintain the first substrate 202 of the thermoelectric cooling element 200 at the first temperature. In an example embodiment, the first temperature corresponds to a temperature range of about 10° C. to about 20° C. In some embodiments, the scope of the disclosure is not limited to the temperature range for the first temperature being limited to 10° C. to 20° C., but may vary depending on various factors such as a label type, surface characteristics of the label 117, etc., without departing from the scope of the disclosure. In an embodiment, the first substrate 202 is maintained at the first temperature for cooling the base plate 302 of the thermoelectric cooling assembly 300, thereby resulting in cooling the label 117 that has temperature above the threshold temperature. In an embodiment, the output signal generated by the control system is indicative of the current supplied to the thermoelectric cooling element 200 to maintain the second substrate 206 of the thermoelectric cooling element 200 at the second temperature. In an embodiment, the second temperature is different than the first temperature. For example, the second temperature corresponds to a temperature range of about 20° C. to about 40° C. In some embodiments, the scope of the disclosure is not limited to the temperature range for the second temperature being limited to 20° C. to 40° C., but may vary depending on various factors such as thermal resistance capacity of the second substrate 206, thermal resistance capacity of the heat sink unit 304, a label type, properties of adhesives used in the labels, etc., without departing from the scope of the disclosure.

Further, the control system 406 may be communicatively coupled with the heat sink unit 304 of the thermoelectric cooling assembly 300 to control the operation of the heat sink unit 304. For example, the thermoelectric cooling element 200 exhibits thermoelectric cooling effect to transfer the excess heat from the first substrate 202 to the second substrate 206 for cooling the base plate 302, on detecting that the label 117 that comes in contact with the base plate 302 has a temperature above the predetermined threshold temperature that may result in adhesive leakage in the label 117. In order to maintain the second substrate 206 at the second temperature such that the second substrate 206 is not damaged by the excess heat, the control system 406 may control the heat sink to extract the excess heat from the second substrate 206 and dissipate the excess heat out of the printer apparatus 100 by conventional convection mechanisms, as described above in conjunction with FIG. 3. Hence, the thermoelectric cooling assembly 300 provided in the various embodiments disclosed herein, avoid contamination of the printer apparatus 100 that may be caused by adhesive leakage of the plurality of labels 117.

Figure 5:
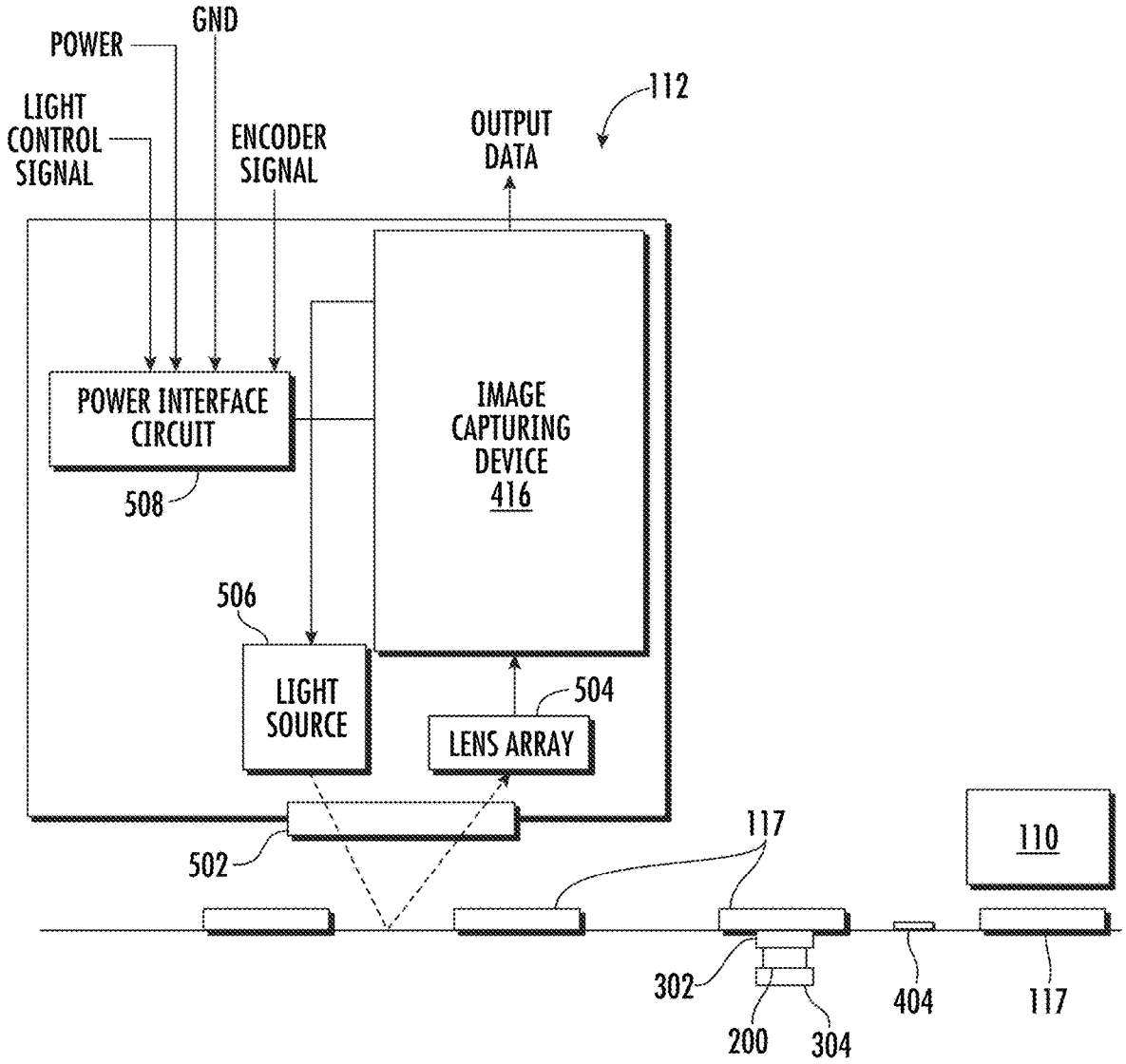
FIG. 5 illustrates schematics of the printer apparatus comprising an optical verification unit and the thermoelectric cooling assembly, according to one or more embodiments described herein.

FIG. 5 illustrates schematics of the printer apparatus comprising the optical verification unit 416 and the thermoelectric cooling assembly 300, according to one or more embodiments described herein. In an embodiment, the thermoelectric cooling assembly 300 is configured to be positioned between the optical verification unit 416 and the printhead 110. A label 117 comprising content printed thereon by the printhead 110 is detected at the base plate 302 of the thermoelectric cooling assembly 300. The control system of the printer apparatus 100 receives, from the sensor unit 404 of the printer apparatus 100, sensor signals indicative of the temperature of the label 117. In response to comparing the temperature of the label 117 with the threshold temperature, the control system generates an output signal indicative of current supplied to the thermoelectric cooling element 200 of the thermoelectric cooling assembly 300 to adjust the temperature of the thermoelectric cooling element 200, thereby adjusting the temperature of the label 117. For example, when the temperature of the label 117 is above the threshold temperature, the control system generates an output signal to increase the current supplied to the thermoelectric cooling element 200 that in turn cools the first substrate 202 of the thermoelectric cooling element 200, thereby cooling the base plate 302 that is coupled to the first substrate 202. Consequently, the label 117 in contact with the base plate 302 is cooled and the temperature of the label 117 is brought below the threshold temperature. In another example, when the temperature of the label 117 is equal to or below the threshold temperature, the control system generates an output signal to supply the required current to the thermoelectric cooling element 200 such that the first substrate 202 is maintained at the first temperature, thereby maintaining the temperature of the label 117 that comes in contact with the base plate 302 of the thermoelectric cooling assembly 300. Therefore, the labels 117 that traverse towards the optical verification unit 416 after being subjected to thermoelectric temperature control by the thermoelectric cooling assembly 300 have their respective adhesive layer intact, thereby preventing any contamination due to adhesive leakage in the optical verification unit 416 or any other part of the printer apparatus 100.

As exemplarily illustrated in FIG. 5, the optical verification unit housing 112 includes a window 502, a circuit board (not shown), the optical verification unit 416, a lens array 504, and a plurality of light sources 506 (e.g., light emitting diodes (LEDs)).

The window 502, which may correspond to an opening or may be composed of a transparent material (such as glass), permits the plurality of light sources 506 in the optical verification unit housing 112 to project light upon the printed media 116. Based on the projected light, the optical verification unit 416 captures an image of the printed media 116 as the printed media 116 traverses across the window 502 (in the print direction).

The circuit board may be configured to facilitate communication between various other internal components, such as the optical verification unit 416, the lens array 504, and the plurality of light sources 506. In various embodiments, the internal components may be electrically coupled with each other through the circuit board.

In an example embodiment, the optical verification unit 416 may be an array of linear sensors configured to capture images of the printed media 116 as the media 116 traverses past the window 502.

The lens array 504 may be a group of lenses arranged in a specific pattern configured to receive reflected light from the printed media 116 and direct the reflected light on the optical verification unit 416. In an example embodiment, the optical verification unit 416 may generate the image of the printed content based on the received reflected light. In some examples, the lens array 504 may have one or more rows of gradient index lenses, with each lens having a continuous change of refractive index inside a cylinder. The one or more rows of gradient index (GRIN) lenses, such as a SELFOC® brand lens array, couple the light reflected from the printed content on the media 116 to the optical verification unit 416.

In an example embodiment, the light board may be configured to house and support the plurality of light sources 506 (e.g., light emitting diodes (LEDs)). In an example embodiment, the plurality of light sources 506 may be spread out across the length of the light board in a specified pattern for illuminating the printed media 116. The plurality of light sources 506 may be configured to illuminate and project light upon the printed media 116 as the media 116 traverse across the window 502. The plurality of light sources 506 correspond to LEDs that are fixed on the light board in the specified pattern.

In an embodiment, the optical verification unit housing 112 may be configured to receive a plurality of signals including an encoder signal, power and ground signals, and a light control signal from the control system 406 of the printer apparatus 100. The power interface circuit 508 receives such signals, buffers the signals as necessary, and supplies appropriate signals to several other components in the optical verification unit housing 112. The power interface circuit 508 may include the necessary components to supply appropriate power and ground signals to the other components in the optical verification unit housing 112.

In some examples, the light source 506 provides light through window 502 to illuminate the field of view of the optical verification unit 416. In an example embodiment, the field of view of the optical verification unit 416 may include the label 117. The reflected light from the label 117 passes through window 502 to lens array 504 and is measured by the optical verification unit 416. In some examples, the optical verification unit 416 may transmit the captured image to the control system 406.

Figure 6:
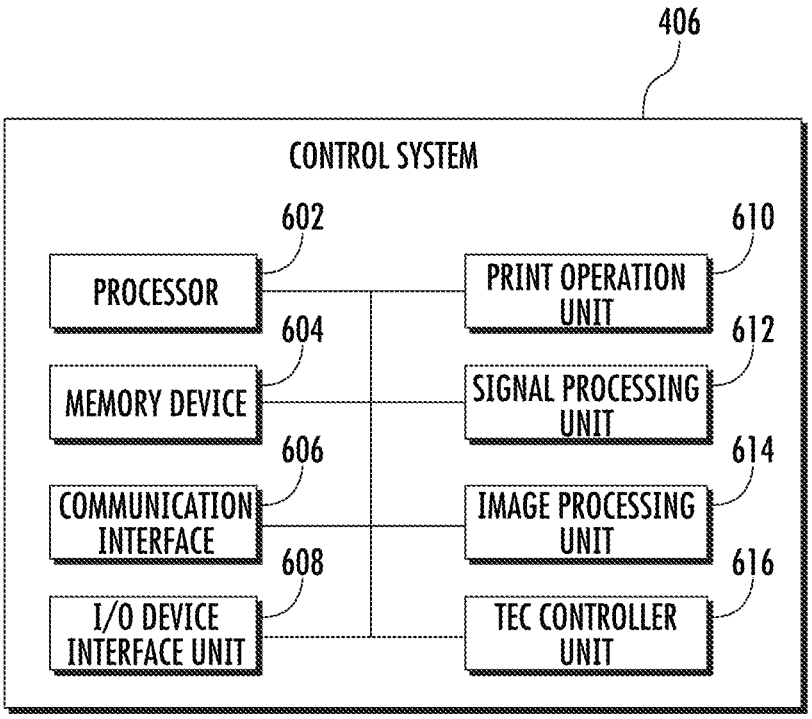
FIG. 6 illustrates a block diagram of a control system, according to one or more embodiments described herein.

FIG. 6 illustrates a block diagram of the control system 406, according to one or more embodiments described herein. The control system 406 includes a processor 602, a memory device 604, a communication interface 606, an input/output (I/O) device interface unit 608, a print operation unit 610, a signal processing unit 612, an image processing unit 614, and a thermoelectric cooling (TEC) controller unit 616. In an example embodiment, the processor 602 may be communicatively coupled to each of the memory device 604, the communication interface 606, the I/O device interface unit 608, the print operation unit 610, the signal processing unit 612, the image processing unit 614.

The processor 602 may be embodied as a means including one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an application specific integrated circuit (ASIC) or field programmable gate array (FPGA), remote or "cloud" processors, or some combination thereof. Accordingly, although illustrated in FIG. 6 as a single processor, in an embodiment, the processor 602 may include a plurality of processors and signal processing modules. The plurality of processors may be embodied on a single electronic device or may be distributed across a plurality of electronic devices collectively configured to function as the circuitry of the control system 406. The plurality of processors may be in operative communication with each other and may be collectively configured to perform one or more functionalities of the circuitry of the control system 406, as described herein. In an example embodiment, the processor 602 may be configured to execute instructions stored in the memory device 604 or otherwise accessible to the processor 602. These instructions, when executed by the processor 602, may cause the circuitry of the control system 406 to perform one or more of the functionalities, as described herein.

In an embodiment, the processor 602 is communicatively coupled to the thermoelectric cooling assembly 300 of the printer apparatus 100. In an embodiment, the processor 602 is configured to receive, from the sensor unit 404 of the printer apparatus 100, sensor signals indicative of a temperature of a label 117 of the plurality of labels 117 of the media 116 that comes in contact with the thermoelectric cooling assembly 300. In an embodiment, the processor 602 is configured to compare the temperature of the label 117 of the plurality of labels 117 with a threshold temperature. In an embodiment, the threshold temperature is determined based on surface characteristics of the media 116, a type of an adhesive layer of the label 117, a type of a base plate 302 of the thermoelectric cooling assembly 300 that is configured to be in contact with the media 116 traversing above the thermoelectric cooling assembly 300, a type of a thermoelectric cooling element 200 of the thermoelectric cooling assembly 300, a print speed of the printer apparatus 100, ambient temperature associated with the printer apparatus 100, etc. In an embodiment, in response to the comparison, the processor 602 is configured to generate an output signal indicative of current supplied to the thermoelectric cooling element 200 of the thermoelectric cooling assembly 300 to adjust the temperature of the thermoelectric cooling element 200. In an embodiment, the processor 602 is configured to generate the output signal indicative of the current supplied to the thermoelectric cooling element 200 to maintain the first substrate 202 of the thermoelectric cooling element 200 at a first temperature for cooling the base plate 302 of the thermoelectric cooling assembly 300. In an embodiment, the processor 602 is configured to generate the output signal indicative of the current supplied to the thermoelectric cooling element 200 to maintain the second substrate 206 of the thermoelectric cooling element 200 at a second temperature. In an embodiment, the second temperature is different than the first temperature.

Whether configured by hardware, firmware/software methods, or by a combination thereof, the processor 602 may include an entity capable of performing operations according to embodiments of the present disclosure while configured accordingly. Thus, for example, when the processor 602 is embodied as an ASIC, FPGA or the like, the processor 602 may include specifically configured hardware for conducting one or more operations described herein. Alternatively, as another example, when the processor 602 is embodied as an executor of instructions, such as may be stored in the memory device 604, the instructions may specifically configure the processor 602 to perform one or more algorithms and operations described herein.

Thus, the processor 602 used herein may refer to a programmable microprocessor, microcomputer or multiple processor chip or chips that can be configured by software instructions (applications) to perform a variety of functions, including the functions of the various embodiments described above. In some devices, multiple processors may be provided dedicated to wireless communication functions and one processor dedicated to running other applications. Software applications may be stored in the internal memory before they are accessed and loaded into the processors. The processors may include internal memory sufficient to store the application software instructions. In many devices, the internal memory may be a volatile or nonvolatile memory, such as flash memory, or a mixture of both. The memory can also be located internal to another computing resource (e.g., enabling computer readable instructions to be downloaded over the Internet or another wired or wireless connection).

The memory device 604 may include suitable logic, circuitry, and/or interfaces that are adapted to store a set of instructions that is executable by the processor 602 to perform predetermined operations. Some of the commonly known memory implementations include, but are not limited to, a hard disk, random access memory, cache memory, read only memory (ROM), erasable programmable read-only memory (EPROM) & electrically erasable programmable read-only memory (EEPROM), flash memory, magnetic cassettes, magnetic tape, magnetic disk storage or other magnetic storage devices, a compact disc read only memory (CD-ROM), digital versatile disc read only memory (DVD-ROM), an optical disc, circuitry configured to store information, or some combination thereof. In an embodiment, the memory device 604 may be integrated with the processor 602 on a single chip, without departing from the scope of the disclosure.

The communication interface 606 may correspond to a communication interface that may facilitate transmission and reception of messages and data to and from various devices. For example, the communication interface 606 is communicatively coupled with a computing device (not shown). Examples of the communication interface 606 may include, but are not limited to, an antenna, an Ethernet port, a USB port, a serial port, or any other port that can be adapted to receive and transmit data. The communication interface 606 transmits and receives data and/or messages in accordance with the various communication protocols, such as, I2C, TCP/IP, UDP, and 5G, 5G, or 5G communication protocols.

The I/O device interface unit 608 may include suitable logic and/or circuitry that may be configured to communicate with the one or more components of the printer apparatus 100, in accordance with one or more device communication protocols such as, but not limited to, I2C communication protocol, Serial Peripheral Interface (SPI) communication protocol, Serial communication protocol, Control Area Network (CAN) communication protocol, and 1-Wire® communication protocol. In an example embodiment, the I/O device interface unit 608 may communicate with the media sensor 402, the optical verification unit 416, the printer cover sensor 113, the stepper motor, the thermoelectric cooling assembly 300, the sensor unit 404, etc. In an example embodiment, the I/O device interface unit 608 may receive the sensor signals from the sensor unit 404. Further, in some examples, the I/O device interface unit 608 may cause the stepper motor to actuate the first electrical drive associated with the media hub 102. As described, the actuation of the first electrical drive causes the media hub 102 to rotate and supply the media 116 on the media path 118. Further, in some examples, the I/O device interface unit 608 may send the output signal to the thermoelectric cooling element 200 of the thermoelectric cooling assembly 300 to adjust the temperature of the thermoelectric cooling element 200. Some examples of the I/O device interface unit 608 may include, but not limited to, a Data Acquisition (DAQ) card, an electrical drives driver circuit, and/or the like.

The print operation unit 610 may include suitable logic and/or circuitry that may cause the printer apparatus 100 to perform a print operation. In an example embodiment, the print operation unit 610 may be configured to receive the print job from the computing device. Thereafter, the print operation unit 610 may be configured to perform the print operation based on the print job. For instance, during the print operation, the print operation unit 610 may be configured to instruct the I/O device interface unit 608 to actuate the first electrical drive, the second electrical drive, and the third electrical drive, which are associated with the media hub 102, the ribbon drive assembly 106, and ribbon take-up hub 108, respectively, to cause the traversal of the media 116 and the ribbon 122 along the media path 118 and the ribbon path 124, respectively. Further, the print operation unit 610 may be configured to control the operation of the printhead 110 (for example energization of the one or more heating elements and the vertical translation of the printhead 110) to perform the print operation. In some embodiments, the print operation unit 610 includes a separate processor. In some embodiments, the print operation unit 610 may leverage processor 602. The print operation unit 610 may be implemented using hardware components of the apparatus configured by either hardware or software for implementing the functions described herein.

In an embodiment, the signal processing unit 612 may include suitable logic and/or circuitry for analyzing the signal received from the media sensor 402. In another embodiment, the signal processing unit 612 may include suitable logic and/or circuitry for analyzing the sensor signals received from the sensor unit 404 or the output signal sent to the thermoelectric cooling element 200 of the thermoelectric cooling assembly 300. In an example embodiment, the signal processing unit 612 may include a digital signal processor that may be configured to analyze the signal, the sensor signals, the output signal, etc., to determine one or more measurements of one or more characteristics of the signal, the sensor signals, the output signal, etc. In an example embodiment, the one or more characteristics of the signal, the sensor signals, the output signal, etc., may include, but are not limited to, an amplitude and a frequency of the signal, the sensor signals, the output signal, etc. Further, the signal processing unit 612 may utilize one or more signal processing techniques such as, but not limited to, Fast Fourier Transform (FFT), Discrete Fourier Transform (DFT), Discrete Time Fourier Transform (DTFT) to analyze the signal, the sensor signals, the output signal, etc. In some embodiments, the signal processing unit 612 includes a separate processor. In some embodiments, the signal processing unit 612 may leverage processor 602. The signal processing unit 612 may be implemented using hardware components of the apparatus configured by either hardware or software for implementing the functions described herein.

The image processing unit 614 may include suitable logic and/or circuitry for receiving the image of the printed content from the optical verification unit 416 in the optical verification unit housing 112. In an example embodiment, the optical verification unit 416 may be configured to verify the printed content based on the captured image of the printed content, as is described in conjunction with FIG. 5. In some embodiments, the optical verification unit 416 includes a separate processor. In some embodiments, the optical verification unit 416 may leverage processor 602. The optical verification unit 416 may be implemented using hardware components of the apparatus configured by either hardware or software for implementing the functions described herein.

The TEC controller unit 616 may include suitable logic and/or circuitry that may cause the thermoelectric cooling assembly 300 to perform the thermoelectric cooling effect to control the temperature of the plurality of labels 117 of the media 116, thereby preventing contamination in the printer apparatus 100 caused by adhesive leakage from the plurality of labels 117. In an example embodiment, the TEC controller unit 616 may be configured to receive the output signal, from the processor, which is indicative of current supplied to the thermoelectric cooling element 200 of the thermoelectric cooling assembly 300. Thereafter, the TEC controller unit 616 may be configured to adjust the temperature of the thermoelectric cooling element 200 based on the output signal. For instance, during the thermoelectric cooling operation, the TEC controller unit 616 may be configured to instruct the I/O device interface unit 608 to send the output signal to the thermoelectric cooling element 200 to adjust the first temperature of the first substrate 202 or the second temperature of the second substrate 206. Further, the TEC controller unit 616 may be configured to control the operation of the thermoelectric cooling element 200, the heat sink unit 304, and/or the base plate 302 to perform the thermoelectric cooling operation. In some embodiments, the TEC controller unit 616 includes a separate processor. In some embodiments, the TEC controller unit 616 may leverage processor 602. The TEC controller unit 616 may be implemented using hardware components of the apparatus configured by either hardware or software for implementing the functions described herein.

In some examples, the scope of the disclosure is not limited to the control system 406 comprising the aforementioned components and/or units. In an example embodiment, some of the components may be implemented in other components of the printer apparatus 100. For example, the image processing unit 614 may be implemented in the optical verification unit 416 (in the optical verification unit housing 112), without departing from the scope of the disclosure. In another example, the TEC controller unit 616 may be implemented in the thermoelectric cooling assembly 300, without departing from the scope of the disclosure. Similarly, in some examples, the signal processing unit 612 may be implemented in the media sensor 402 or the sensor unit 404, without departing from the scope of the disclosure.

Figure 7:
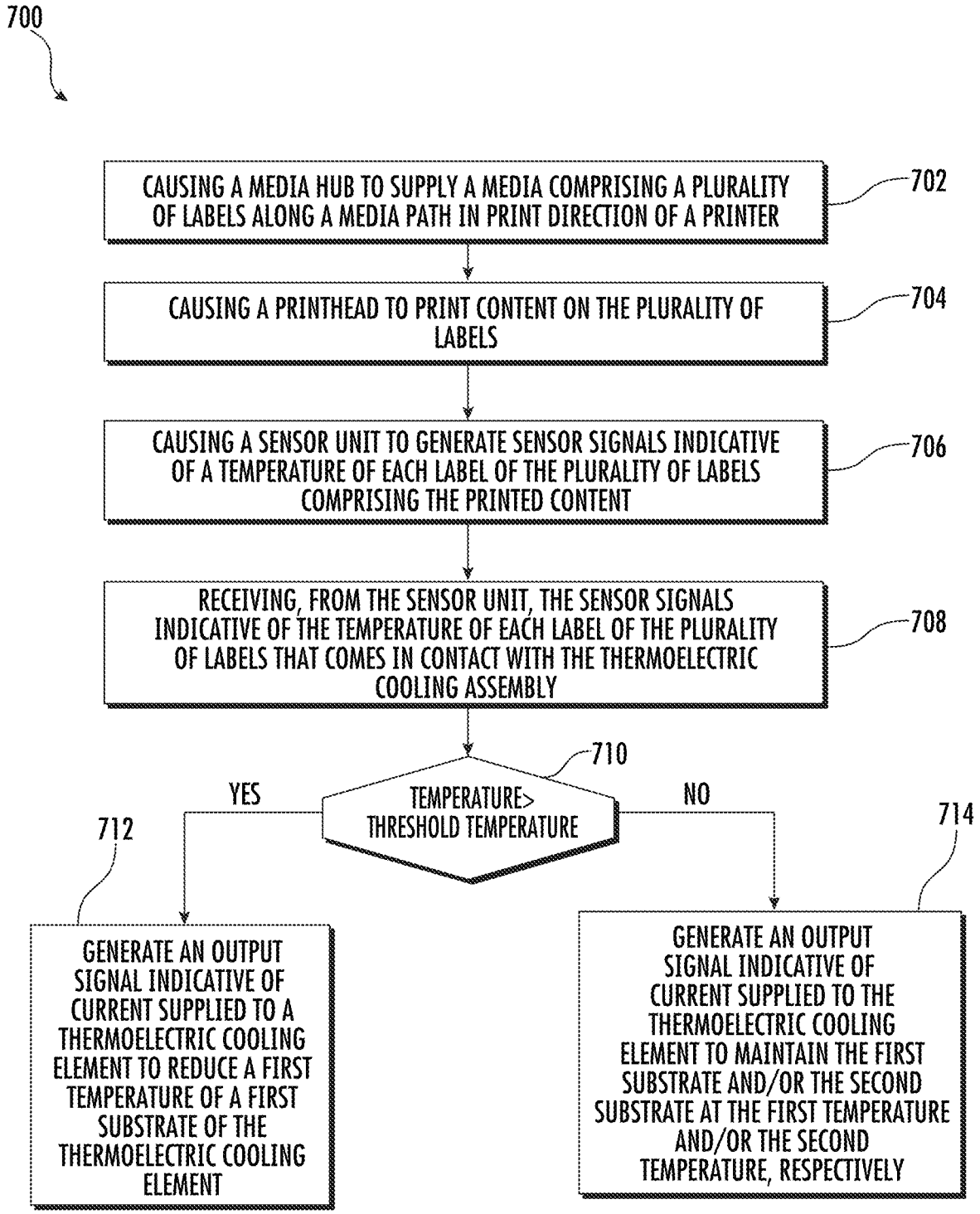
FIG. 7 illustrates a flowchart for operating the printer apparatus comprising the thermoelectric cooling assembly, according to one or more embodiments described herein.

FIG. 7 illustrates an example flowchart of the operation performed by an apparatus, such as the printer apparatus 100 as shown in FIG. 1, in accordance with example embodiments of the present invention. It will be understood that each block of the flowchart, and combinations of blocks in the flowchart, may be implemented by various means, such as hardware, firmware, one or more processors, circuitry and/or other devices associated with execution of software including one or more computer program instructions. For example, one or more of the procedures described above may be embodied by computer program instructions. In this regard, the computer program instructions which embody the procedures described above may be stored by a memory of an apparatus employing an embodiment of the present invention and executed by a processor in the apparatus. As will be appreciated, any such computer program instructions may be loaded onto a computer or other programmable apparatus (e.g., hardware) to produce a machine, such that the resulting computer or other programmable apparatus provides for implementation of the functions specified in the flowcharts' block(s). These computer program instructions may also be stored in a non-transitory computer-readable storage memory that may direct a computer or other programmable apparatus to function in a particular manner, such that the instructions stored in the computer-readable storage memory produce an article of manufacture, the execution of which implements the function specified in the flowcharts' block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowcharts' block(s). As such, the operations of FIG. 7, when executed, convert a computer or processing circuitry into a particular machine configured to perform an example embodiment of the present invention. Accordingly, the operations of FIG. 7 define algorithms for configuring a computer or a processor, to perform an example embodiment. In some cases, a general purpose computer may be provided with an instance of the processor which performs the algorithm of FIG. 7 to transform the general purpose computer into a particular machine configured to perform an example embodiment.

Accordingly, blocks of the flowchart support combinations of means for performing the specified functions and combinations of operations for performing the specified functions. It will also be understood that one or more blocks of the flowcharts', and combinations of blocks in the flowchart, can be implemented by special purpose hardware-based computer systems which perform the specified functions, or combinations of special purpose hardware and computer instructions.

FIG. 7 illustrates a flowchart 700 for operating the printer apparatus 100 comprising the thermoelectric cooling assembly 300, according to one or more embodiments described herein.

At step 702, the printer apparatus 100 may include means, such as the control system 406, the processor 602, the I/O device interface unit 608, and/or the like, for causing the media hub 102 of the printer apparatus 100 to supply the media 116 comprising the plurality of labels 117 along the media path 118 in the print direction of the printer apparatus 100.

At step 704, the printer apparatus 100 may include means, such as the control system 406, the processor 602, the I/O device interface unit 608, and/or the like, for causing the printhead 110 of the printer apparatus 100 to print content on the plurality of labels 117. In an embodiment, the content is printed on a printable surface of a label 117 of the plurality of labels 117. In an embodiment, the label 117 of the plurality of labels 117 comprises an adhesive layer on a non-printing surface of the label 117 that is in releasable contact with a liner layer of the label 117.

At step 706, the printer apparatus 100 may include means, such as the control system 406, the processor 602, the I/O device interface unit 608, and/or the like, for causing the sensor unit 404 of the printer apparatus 100 to generate sensor signals indicative of the temperature of the label 117 comprising the printed content.

At step 708, the printer apparatus 100 may include means, such as the control system 406, the processor 602, the I/O device interface unit 608, and/or the like, for receiving, from the sensor unit 404, the sensor signals indicative of the temperature of the label 117 that comes in contact with the thermoelectric cooling assembly 300 of the printer apparatus 100.

At step 710, the printer apparatus 100 may include means, such as the control system 406, the processor 602, the I/O device interface unit 608, and/or the like, for comparing the temperature of the label 117 with a threshold temperature. In an embodiment, the threshold temperature is determined based on surface characteristics of the media 116, a type of an adhesive layer of the label 117, a type of the base plate 302 of the thermoelectric cooling assembly 300 that is configured to be in contact with the media 116 traversing above the thermoelectric cooling assembly 300, a type of a thermoelectric cooling element 200 of the thermoelectric cooling assembly 300, a print speed of the printer apparatus 100, ambient temperature associated with the printer apparatus 100, etc.

At step 712, the printer apparatus 100 may include means, such as the control system 406, the processor 602, the I/O device interface unit 608, and/or the like, for generating an output signal indicative of current supplied to the thermoelectric cooling element 200 of the thermoelectric cooling assembly 300 to adjust the temperature of the thermoelectric cooling element 200 of the thermoelectric cooling assembly 300, in response to the comparison. For example, at step 712, the printer apparatus 100 may include means, such as the control system 406, the processor 602, the I/O device interface unit 608, and/or the like, for generating the output signal that is indicative of the current supplied to the thermoelectric cooling element 200 to reduce the first temperature of the first substrate 202 of the thermoelectric cooling element 200 for cooling the base plate 302 of the thermoelectric cooling assembly 300, when the temperature of the label 117 exceeds the threshold temperature. In an embodiment, the printer apparatus 100 may include means, such as the control system 406, the processor 602, the I/O device interface unit 608, and/or the like, for generating the output signal that is indicative of the current supplied to the thermoelectric cooling element 200 to maintain the second substrate 206 of the thermoelectric cooling element 200 at a second temperature. In an embodiment, the second temperature is different than the first temperature. For example, the printer apparatus 100 may include means, such as the control system 406, the processor 602, the I/O device interface unit 608, and/or the like, for generating the output signal that is indicative of the current supplied to the thermoelectric cooling element 200 to increase the second temperature of the second substrate 206 of the thermoelectric cooling element 200, when the temperature of the label 117 exceeds the threshold temperature. In an embodiment, the printer apparatus 100 may include means, such as the control system 406, the processor 602, the I/O device interface unit 608, and/or the like, for causing the heat sink unit 304 of the thermoelectric cooling assembly 300 to dissipate heat from the second substrate 206, when the second temperature of the second substrate 206 is increased in response to the temperature of the label 117 exceeding the threshold temperature.

At step 714, the printer apparatus 100 may include means, such as the control system 406, the processor 602, the I/O device interface unit 608, and/or the like, for generating the output signal that is indicative of the current supplied to the thermoelectric cooling element 200 to maintain the first substrate 202 at the first temperature and the second substrate 206 at the second temperature, when the temperature of the label 117 is below or equal to the threshold temperature.

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art, the order of steps in some of the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an," or "the" is not to be construed as limiting the element to the singular.

The hardware used to implement the various illustrative logics, logical blocks, modules, and circuits described in connection with the aspects disclosed herein may include a general purpose processor, a digital signal processor (DSP), a special-purpose processor such as an application specific integrated circuit (ASIC) or a field programmable gate array (FPGA), a programmable logic device, discrete gate or transistor logic, discrete hardware components, or any combination thereof designed to perform the functions described herein. A general-purpose processor may be a microprocessor, but, in the alternative, the processor may be any processor, controller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, or in addition, some steps or methods may be performed by circuitry that is specific to a given function.

In one or more example embodiments, the functions described herein may be implemented by special-purpose hardware or a combination of hardware programmed by firmware or other software. In implementations relying on firmware or other software, the functions may be performed as a result of execution of one or more instructions stored on one or more non-transitory computer-readable media and/or one or more non-transitory processor-readable media. These instructions may be embodied by one or more processor-executable software modules that reside on the one or more non-transitory computer-readable or processor-readable storage media. Non-transitory computer-readable or processor-readable storage media may in this regard comprise any storage media that may be accessed by a computer or a processor. By way of example but not limitation, such non-transitory computer-readable or processor-readable media may include RAM, ROM, EEPROM, FLASH memory, disk storage, magnetic storage devices, or the like. Disk storage, as used herein, includes compact disc (CD), laser disc, optical disc, digital versatile disc (DVD), floppy disk, and Blu-ray Disc™, or other storage devices that store data magnetically or optically with lasers. Combinations of the above types of media are also included within the scope of the terms non-transitory computer-readable and processor-readable media. Additionally, any combination of instructions stored on the one or more non-transitory processor-readable or computer-readable media may be referred to herein as a computer program product.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

The invention claimed is:

1. A printer apparatus comprising:

a thermoelectric cooling assembly positioned downstream of a printhead in a print direction of the printer apparatus, wherein the thermoelectric cooling assembly comprises:

a thermoelectric cooling element comprising:

a first substrate;

a second substrate separated from the first substrate by a space therebetween; and a first plurality of semiconductor elements electrically coupled to a second plurality of semiconductor elements in the space between the first substrate and the second substrate; and a base plate electrically coupled to the first substrate of the thermoelectric cooling element;

a processor communicatively coupled to the thermoelectric cooling assembly, wherein the processor is configured to:

receive, from a sensor unit of the printer apparatus that is positioned proximate to the thermoelectric cooling assembly, sensor signals indicative of a temperature of a label of a plurality of labels of a media that comes in contact with the thermoelectric cooling assembly;

compare the temperature of the label of the plurality of labels with a threshold temperature; and in response to the comparison, generate an output signal indicative of current supplied to the thermoelectric cooling element of the thermoelectric cooling assembly to adjust the temperature of the thermoelectric cooling element; and an optical verification unit positioned downstream of the printhead in the print direction, wherein the optical verification unit is configured to capture an image of the media traversing along a media path of the printer apparatus below the optical verification unit, and wherein the thermoelectric cooling assembly is configured to be positioned between the optical verification unit and the printhead.

2. The printer apparatus of claim 1, wherein the base plate of the thermoelectric cooling assembly is configured to be proximate to the plurality of labels of the media traversing along a media path of the printer apparatus above the thermoelectric cooling assembly.

3. The printer apparatus of claim 1, wherein the processor is configured to generate the output signal indicative of the current supplied to the thermoelectric cooling element to maintain the first substrate of the thermoelectric cooling element at a first temperature, and wherein the first substrate is maintained at the first temperature for cooling the base plate of the thermoelectric cooling assembly.

4. The printer apparatus of claim 1, wherein the processor is configured to generate the output signal indicative of the current supplied to the thermoelectric cooling element to maintain the second substrate of the thermoelectric cooling element at a second temperature, the second temperature being different than the first temperature.

5. The printer apparatus of claim 1, wherein the thermoelectric cooling assembly further comprises a heat sink unit electrically coupled to the second substrate of the thermoelectric cooling element, wherein the heat sink unit is configured to dissipate heat from the second substrate.

6. The printer apparatus of claim 1, wherein the threshold temperature is determined based on at least one of surface characteristics of the media, a type of an adhesive layer of the label, a type of the base plate of the thermoelectric cooling assembly, a type of the thermoelectric cooling element of the thermoelectric cooling assembly, a print speed of the printer apparatus, and ambient temperature associated with the printer apparatus.

7. A printer apparatus comprising:

a media hub configured to supply a media comprising a plurality of labels along a media path in a print direction of the printer apparatus;

a printhead positioned adjacent to the media path and downstream of the media hub in the print direction, wherein the printhead is configured to print content on the plurality of labels;

a sensor unit positioned downstream of the printhead in the print direction, wherein the sensor unit is configured to generate sensor signals indicative of a temperature of a label of the plurality of labels comprising the printed content;

a thermoelectric cooling assembly positioned downstream of the printhead in the print direction and proximate to the sensor unit;

a processor communicatively coupled to the sensor unit and the thermoelectric cooling assembly, wherein the processor is configured to:

receive, from the sensor unit, the sensor signals indicative of the temperature of the label of the plurality of labels that comes in contact with the thermoelectric cooling assembly;

compare the temperature of the label of the plurality of labels with a threshold temperature; and in response to the comparison, generate an output signal indicative of current supplied to the thermoelectric cooling assembly to adjust the temperature of the thermoelectric cooling assembly; and an optical verification unit positioned downstream of the printhead in the print direction, wherein the optical verification unit is configured to capture an image of the printed media as the printed media traverses along the media path below the optical verification unit, and wherein the thermoelectric cooling assembly is positioned between the optical verification unit and the printhead.

8. The printer apparatus of claim 7, wherein the thermoelectric cooling assembly comprises:

a thermoelectric cooling element comprising:

a first substrate;

a second substrate separated from the first substrate by a space therebetween; and a first plurality of semiconductor elements electrically coupled to a second plurality of semiconductor elements in the space between the first substrate and the second substrate; and a base plate electrically coupled to the first substrate of the thermoelectric cooling element and configured to be proximate to the plurality of labels of the media traversing along the media path above the thermoelectric cooling assembly.

9. The printer apparatus of claim 8, wherein the processor is configured to generate the output signal indicative of the current supplied to the thermoelectric cooling element of the thermoelectric cooling assembly to maintain the first substrate of the thermoelectric cooling element at a first temperature, and wherein the first substrate is maintained at the first temperature for cooling the base plate of the thermoelectric cooling assembly.

10. The printer apparatus of claim 8, wherein the processor is configured to generate the output signal indicative of the current supplied to the thermoelectric cooling element of the thermoelectric cooling assembly to maintain the second substrate of the thermoelectric cooling element at a second temperature, the second temperature being different than the first temperature.

11. The printer apparatus of claim 8, wherein the thermoelectric cooling assembly further comprises a heat sink unit electrically coupled to the second substrate of the thermoelectric cooling element, wherein the heat sink unit is configured to dissipate heat from the second substrate.

12. A method comprising:

receiving, by a processor of a printer apparatus, from a sensor unit of the printer apparatus, sensor signals indicative of a temperature of a label of a plurality of labels of a media that comes in contact with a thermoelectric cooling assembly of the printer apparatus, wherein the sensor unit is positioned downstream of a printhead of the printer apparatus in a print direction of the printer apparatus, and wherein the thermoelectric cooling assembly is positioned downstream of the printhead in the print direction and proximate to the sensor unit;

comparing, by the processor, the temperature of the label of the plurality of labels with a threshold temperature;

in response to the comparison, generating, by the processor, an output signal indicative of current supplied to the thermoelectric cooling assembly to adjust the temperature of the thermoelectric cooling assembly; and wherein the thermoelectric cooling assembly is configured to be positioned between an optical verification unit of the printer apparatus and the printhead, and wherein the optical verification unit is positioned downstream of the printhead in the print direction.

13. The method of claim 12, wherein the thermoelectric cooling assembly comprises:

a thermoelectric cooling element comprising:

a first substrate;

a second substrate separated from the first substrate by a space therebetween; and a first plurality of semiconductor elements electrically coupled to a second plurality of semiconductor elements in the space between the first substrate and the second substrate; and a base plate electrically coupled to the first substrate of the thermoelectric cooling element and configured to be proximate to the plurality of labels of the media traversing along a media path of the printer apparatus above the thermoelectric cooling assembly.

14. The method of claim 13, wherein the output signal is indicative of the current supplied to the thermoelectric cooling element to maintain the first substrate of the thermoelectric cooling element at a first temperature, wherein the first substrate is maintained at the first temperature for cooling the base plate of the thermoelectric cooling assembly.

15. The method of claim 13, wherein the output signal is indicative of the current supplied to the thermoelectric cooling element to maintain the second substrate of the thermoelectric cooling element at a second temperature, the second temperature being different than the first temperature.

16. The method of claim 13, further comprising, causing, by the processor, a heat sink unit of the thermoelectric cooling assembly of the printer apparatus to dissipate heat from the second substrate, wherein the heat sink unit is configured to be electrically coupled to the second substrate of the thermoelectric cooling element.

17. The method of claim 12, wherein the threshold temperature is determined based on at least one of surface characteristics of the media, a type of an adhesive layer of the label, a type of a base plate of the thermoelectric cooling assembly that is configured to be in contact with the media traversing above the thermoelectric cooling assembly, a type of a thermoelectric cooling element of the thermoelectric cooling assembly, a print speed of the printer apparatus, and ambient temperature associated with the printer apparatus.

* * * * *